US008490228B2

(12) United States Patent
Blyskal et al.

(10) Patent No.: US 8,490,228 B2
(45) Date of Patent: Jul. 23, 2013

(54) EASY TO ASSEMBLE, TOOL LESS, EASY TO RECYCLE, MATTRESS SUPPORT

(75) Inventors: Philip Blyskal, Princeton, NJ (US); George A. Clark, Center, OH (US); Jeffrey Rogers, Essex, CT (US)

(73) Assignee: Contract Furniture Supply Ltd, Essex, CT (US)

( * ) Notice: Subject to any disclaimer, the term of this patent is extended or adjusted under 35 U.S.C. 154(b) by 264 days.

(21) Appl. No.: 13/101,475

(22) Filed: May 5, 2011

(65) Prior Publication Data

US 2011/0203050 A1 Aug. 25, 2011

Related U.S. Application Data

(63) Continuation-in-part of application No. PCT/US2009/063334, filed on Nov. 5, 2009.

(60) Provisional application No. 61/112,357, filed on Nov. 7, 2008, provisional application No. 61/247,202, filed on Sep. 30, 2009.

(51) Int. Cl.
*A47C 19/02* (2006.01)

(52) U.S. Cl.
USPC ..... 5/285; 5/286; 5/400

(58) Field of Classification Search
USPC ..... 5/285–286, 200.1, 201, 400
See application file for complete search history.

(56) References Cited

U.S. PATENT DOCUMENTS 3,469,542 A * 9/1969 Ahlenius ..... 108/56.1
3,736,605 A 6/1973 Klein, Jr.
3,761,974 A * 10/1973 Kuss ..... 5/679
4,073,019 A * 2/1978 Fraser ..... 5/679
4,077,074 A 3/1978 Fogel (Continued)

FOREIGN PATENT DOCUMENTS

GB 2331921 A 6/1999

*Primary Examiner* — Fredrick Conley
(74) *Attorney, Agent, or Firm* — Fox Rothschild LLP; Richard C. Woodbridge; Ryan Miller

(57) ABSTRACT

A bed form (10) is made from easy to recycle sections (12*a*, 12*b*, 12*c*, 14*a*, 14*b*, 14*c*, 14*d*) and can be quickly assembled without tools by means of fasteners (64) that can be secured by hand. An egg carton-like base (100) is formed from a first set of long sections (12*a*, 12*b*, 12*c*) having slots on the top edge (16*a*, 16*b*, 16*c*) thereof that engage with slots (38*a*, 38*b*, 38*c*, 38*d*) in the bottom edge (30*a*, 30*b*, 30*c*, 30*d*) of a second set of shorter sections (14*a*, 14*b*, 14*c*, 14*d*). The long and short sections (12*a*, 12*b*, 12*c*, 14*a*, 14*b*, 14*c*, 14*d*) are preferably molded from structural foam and the top edge (16*a*, 16*b*, 16*c*) of the long sections (12*a*, 12*b*, 12*c*) include a plurality of threaded male projections (42*a*, 42*b*, 42*c*) molded into them. Fasteners (64) are used to attach upper deck sections (54*a*, 54*b*, 54*c*) to the threaded projections (42*a*, 42*b*, 42*c*) on the base (100). Each fastener (64) includes a top flange (66), a hollow cylindrical body (68) having an hand engageable fin (70) therein and a lower end having a female threaded section (72, 74) that engages the exterior treads of the threaded projections (42*a*, 42*b*, 42*c*) on the base (100). An individual places one of several fasteners (64) in one of the apertures (56*a*, 56*b*, 56*c*) in one of several deck sections (54*a*, 54*b*, 54*c*), grabs the interior fin (70), engages the threaded projection (42*a*, 42*b*, 42*c*) with the female interior threads (74), and manually rotates the fastener (64) until the flange (66) pulls the deck section (54*a*, 54*b*, 54*c*) firmly down onto the base (100).

18 Claims, 30 Drawing Sheets

U.S. PATENT DOCUMENTS

| | | | | |
|---|---|---|---|---|
| 4,186,452 | A | 2/1980 | Underwood | |
| 4,224,705 | A | 9/1980 | Santo | |
| D257,803 | S | 1/1981 | Underwood | |
| D257,804 | S | 1/1981 | Underwood | |
| 4,267,781 | A | 5/1981 | Powers | |
| 4,354,288 | A | 10/1982 | Dennis | |
| 4,734,946 | A * | 4/1988 | Saputo | 5/400 |
| 4,970,743 | A * | 11/1990 | Wride et al. | 5/679 |
| 5,289,600 | A | 3/1994 | Schermel | |
| 5,469,589 | A | 11/1995 | Steed et al. | |
| 5,564,140 | A | 10/1996 | Shoenhair et al. | |
| 5,953,775 | A | 9/1999 | Mauro et al. | |
| 6,108,834 | A | 8/2000 | Mauro et al. | |
| 7,017,205 | B2 * | 3/2006 | Gladney | 5/400 |
| 7,066,111 | B2 | 6/2006 | McGregor | |
| 7,900,300 | B1 * | 3/2011 | Roberts et al. | 5/400 |
| 8,167,012 | B2 * | 5/2012 | Hicks et al. | 144/329 |
| 2008/0000027 | A1 | 1/2008 | Clenet | |

* cited by examiner

EASY TO ASSEMBLE, TOOL LESS, EASY TO RECYCLE, MATTRESS SUPPORT

CROSS REFERENCE TO RELATED APPLICATIONS

This application is a Continuation-in-Part and claims the priority of PCT Application No. PCT/US2009/063334 filed 5 Nov. 2009 entitled "An Easy To Assemble, Toolless, Easy To Recycle, Mattress Support" by Jeffrey Rogers, Philip Blyskal and George A. Clark; U.S. Provisional Application Ser. No. 61/112,357 filed 7 Nov. 2008 entitled "BED FRAME", by Jeffrey Rogers, Philip Blyskal and George A. Clark; and, U.S. Provisional Application Ser. No. 61/247,202 filed 30 Sep. 2009 entitled "BEDFORM" also by Jeffrey Rogers, Philip Blyskal and George A. Clark, the entire contents and substance of which are hereby incorporated in total by reference.

BACKGROUND OF THE INVENTION

1. Field of the Invention

This invention relates to a bed form made from easy to recycle sections and that can be quickly assembled without tools by means of fasteners that can be attached and secured by hand.

2. Background of the Invention.

Probably the most common bed frame today is the so-called Harvard frame which comprises an adjustable metal frame having legs equipped with casters, onto which a box spring may be set, and to which a headboard may be attached. Harvard frames are somewhat clumsy to assemble and require a box spring to support the basic mattress. Since box springs merely provide a flat support for the mattress it is possible to do away with the box springs and the Harvard frame if an alternative stable platform can be provided. In addition, it is common for hotels and commercial establishments to throw out box springs and old Harvard frame every 6-7 years. Those materials end up in landfills and cost money to dispose of. Consequently, there is a need for inexpensive, easy to assemble, mattress support system that can be disposed of cheaply and in an environmentally responsible fashion.

There have been prior art attempts to provide support for a mattress without the need of the traditional Harvard frame/box spring combination. See the following examples described in the patent literature.

U.S. Pat. No. 4,970,743 discloses a mattress and foundation system comprising a mattress section, a foundation section, a foundation cap, a foundation base and one or more foundation inserts forming a honeycomb unit, notched cross grids, and notched lengthwise grids wherein the grids are interlocked to form the system.

U.S. Pat. No. 4,224,705 discloses a waterbed mattress carried on a platform mounted by an adjustable support consisting of an accordion-type collapsible construction, a series of elongated members, a series of notches equidistantly spaced there along, a series of elongated members inter-nested with the members, and a series of notches equidistantly spaced there along wherein the members are inter-nested with the members by inter-engagement of the notches and, and the members form a collapsible egg crate-like construction such that the members are always oriented parallel to the side rails.

U.S. Pat. No. 4,186,452 discloses a bed support pedestal including two longitudinal vertical planar support members arranged in spaced parallel relationship with one another within the perimeter of the bed, vertically extending slots, substantially vertical planar or support members, and vertically extending slots adapted to intersect with corresponding slots.

U.S. Pat. No. 4,077,074 discloses a waterbed comprising a pedestal, a frame, a water filled mattress, two side rails, a foot rail, an outer pedestal base, pedestal inserts, and pedestal decking.

U.S. Pat. No. 3,761,974 discloses a support for containing a water-filled mattress comprising a vertical walled frame, a vertical free standing modular deck grid for supporting the water mattress above the floor surface, a series of rigid, and waterproofed interconnecting cardboard slats which extend across the interior area defined by the walled frame wherein the slats are partially slit along their intersecting planes.

2008/0000027 discloses a bed frame, comprising: a lower support structure having a head end and a foot end, a mattress platform that supports a mattress, a foot end, a mattress retainer mounted to the mattress platform by a pair of bracket assemblies, injection molded receptacles, a retainer clip, and screws used to secure the receptacle to the mattress platform.

The following U.S. Patents disclose prior art mattress supports of interest but of less likely relevance: U.S. Pat. Nos. 6,108,834; 5,953,755; 5,289,600; 4,073,019; 3,736,605; 3,469,542; Design Patent Applications 257,803; 257,804; and GB2331921.

While there have been past efforts to eliminate the Harvard frame and box spring combination, it is believed that none have succeeded in developing a mattress support that is truly inexpensive to make, easy to assemble without tools and environmentally friendly when manufactured and when ultimately disposed of. It was in the context of the forgoing prior art that the present invention arose.

SUMMARY OF THE INVENTION

Briefly described, the invention comprises a bed form that is made from easy to recycle sections and that can be quickly assembled without tools by means of fasteners that can be secured by hand. The user first removes the contents from a shipping carton. An egg carton-like base is then formed from a first set of three long sections having slots on the top edge thereof that engage with slots in the bottom edge of a second set of four shorter sections. The long and short sections are preferably molded from structural foam and the top edge of the long sections include a plurality of threaded projections molded into them. Molded plastic fasteners are used to attach three upper deck sections to the threaded projections on the base. Each fastener includes a top circular flange, a hollow body having a hand manipulatble fin attached to the inner sidewall thereof, and a lower end having a female threaded section that engages with the exterior treads of the threaded projections on the base. The assembler places one of several fasteners in one of the apertures in one of three deck sections, grabs the interior fin, engages the threaded projection with the female interior threads, and manually rotates the fastener until the flange pulls the deck section firmly down onto the base. The process is repeated until all three deck sections are secured to the base frame. A cloth or other suitable cover can then be placed over the deck sections to protect the surface and give the base a more attractive appearance. A mattress is then place upon the covered deck sections and the bed made up in the conventional fashion. If necessary the bed can be disassembled by reversing the foregoing steps and the items stored or disposed of in an environmentally responsible manner. An inexperienced individual can erect the bed form right out of the box in approximately 5 to 6½ minutes.

These and other feature of the invention will be more fully understood by reference to the following drawings.

DETAILED DESCRIPTION OF THE INVENTION

Figure 1:
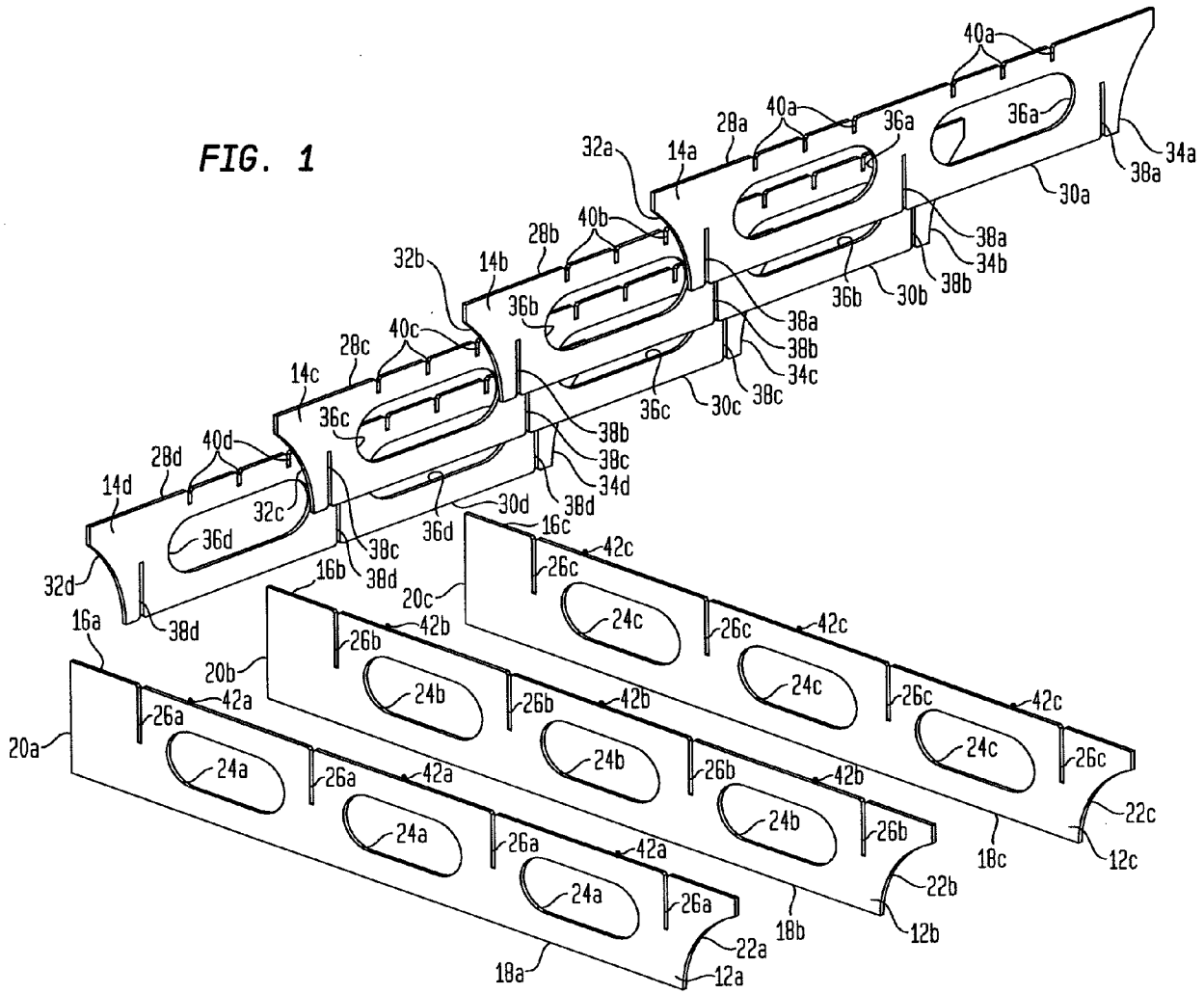
FIG. 1 illustrates the relationship of the three long base board sections with respect to the four transverse shorter base board sections in an exploded view prior to engaging the base boards with each other.
Figure 2:
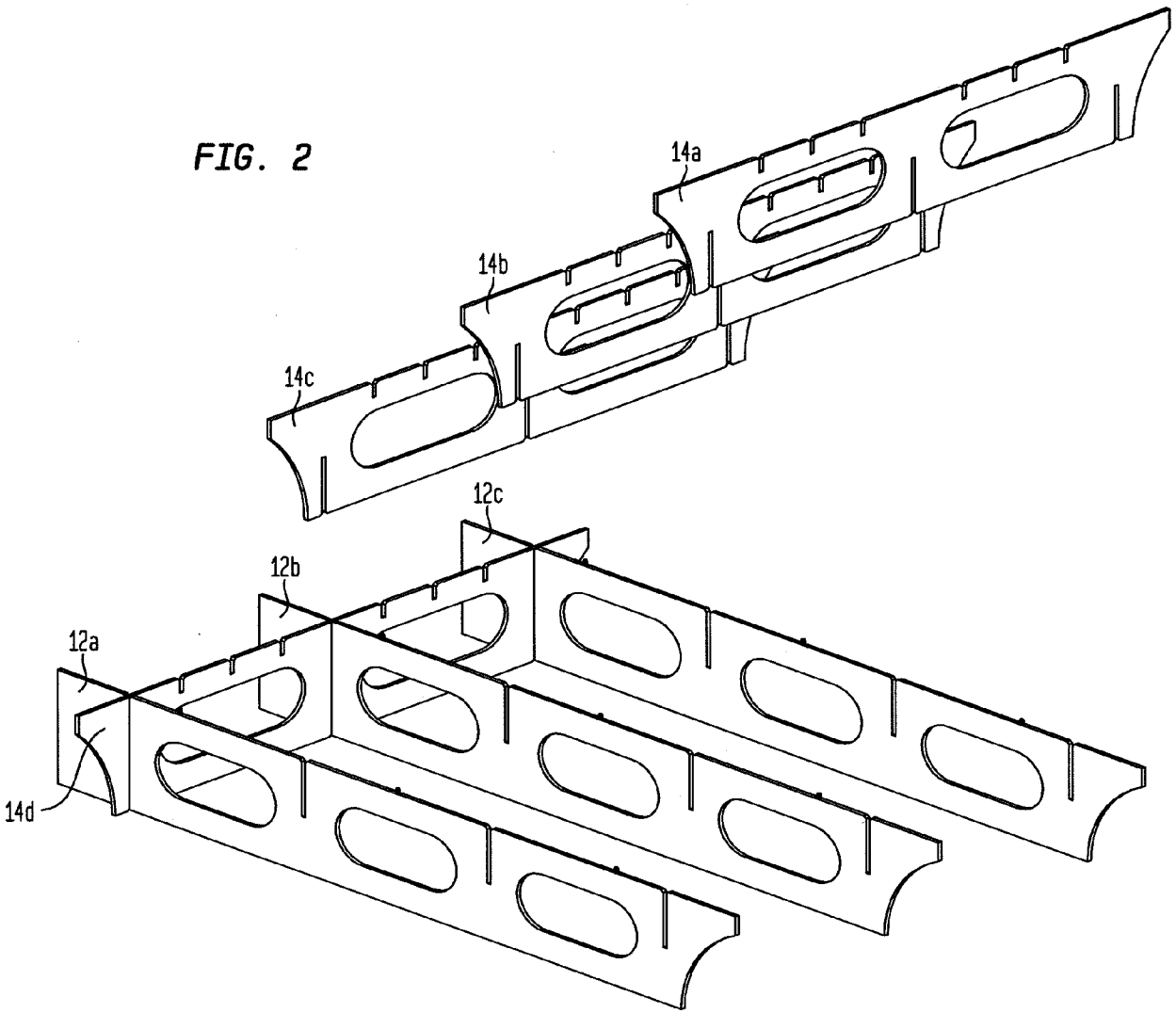
FIGS. 2-4 illustrate how the short base board sections progressively engage with longer base board sections.
Figure 3:
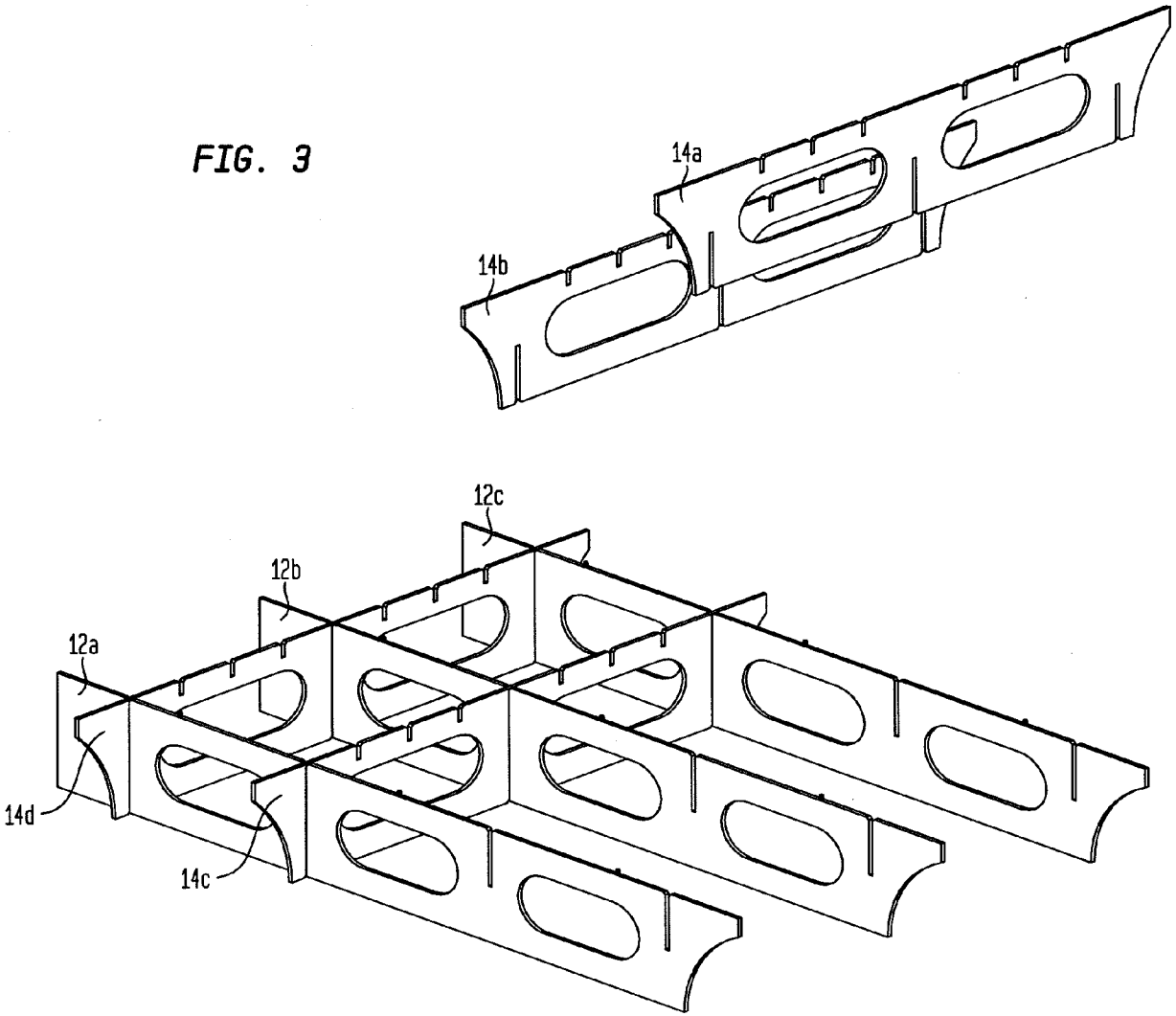
Figure 4:
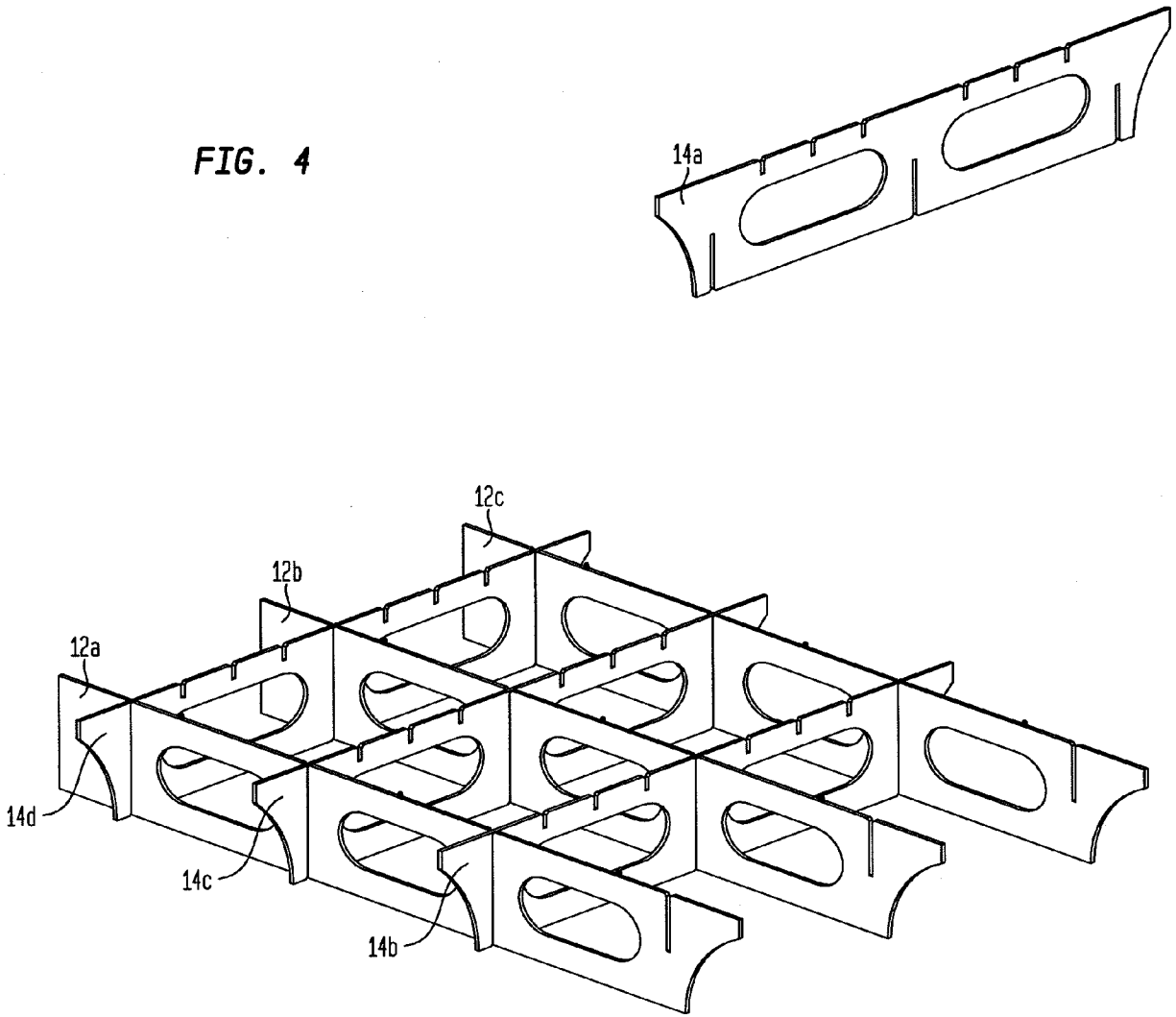

During the course of this description like numbers will be used to identify like elements according to the different views that illustrate the invention.

A unique bedform, according to the preferred embodiment of the invention (10), sits on a base (100) that includes a plurality of long sections (12*a*-12*c*) which engage with another plurality of shorter transverse sections (14*a*-14*d*) as shown in FIGS. 1-5. Three (3) long sections (12*a*-12*c*) are shown engaging with four (4) shorter transverse sections (14*a*-14*d*). The three long support base sections (12*a*-12*c*) each include a top edge (16*a*-16*c*), a bottom edge (18*a*-18*c*), a straight side edge (20*a*-20*c*) and a curved edge (22*a*-22*c*). The curved edge (22*a*-22*c*) is intended to help avoid toe stubbing when the final bedform (10) is erected. Each top edge (16*a*-16*c*) includes four (4) slots (26*a*-26*c*). In order to reduce weight without sacrificing strength, each of the long base support sections (12*a*-12*c*) include three (3) holes or apertures (24*a*-24*c*). The number and shape of apertures (24*a*-24*c*) could be more or less than three (3) depending upon the amount of weight that is to be reduced.

The structure of the four (4) shorter transverse support sections (14*a*-14*d*) is similar to each of the long upper support sections (12*a*-12*d*) and include an upper edge (28*a*-28*d*), a bottom edge (30*a*-30*d*), and a pair of sculpted, curved side edges (32*a*-32*d*) and (34*a*-34*d*). At least two holes (36*a*-36*d*) are included in each of the transverse shorter supports (14*a*-14*d*) to reduce weight in the same manner that holes or apertures (24*a*-24*c*) in the long support base sections (12*a*-12*c*) do.

The bottom edge (30*a*-30*d*) includes three slots (38*a*-38*d*) which mate with the slots (26*a*-26*c*) of the long base support sections (12*a*-12*c*). The top edge (28*a*-28*d*) of the shorter base sections (14*a*-14*d*) include six (6) smaller slots (40*a*-40*d*). The long and short base support sections or boards (12*a*-12*c* and 14*a*-14*d*) are preferably molded using a structural foam process and can be made from either polypropylene or high-density polyethylene thermoplastic material or other thermoplastic material. As such, it is possible to use commercially available recycled material while at the same time maintaining product strength and integrity. An egg crate-like shape is made by progressively inserting slots (38*a*-38*d*) into slots (26*a*-26*c*) in the manner shown in FIGS. 1-5.

Figure 5:
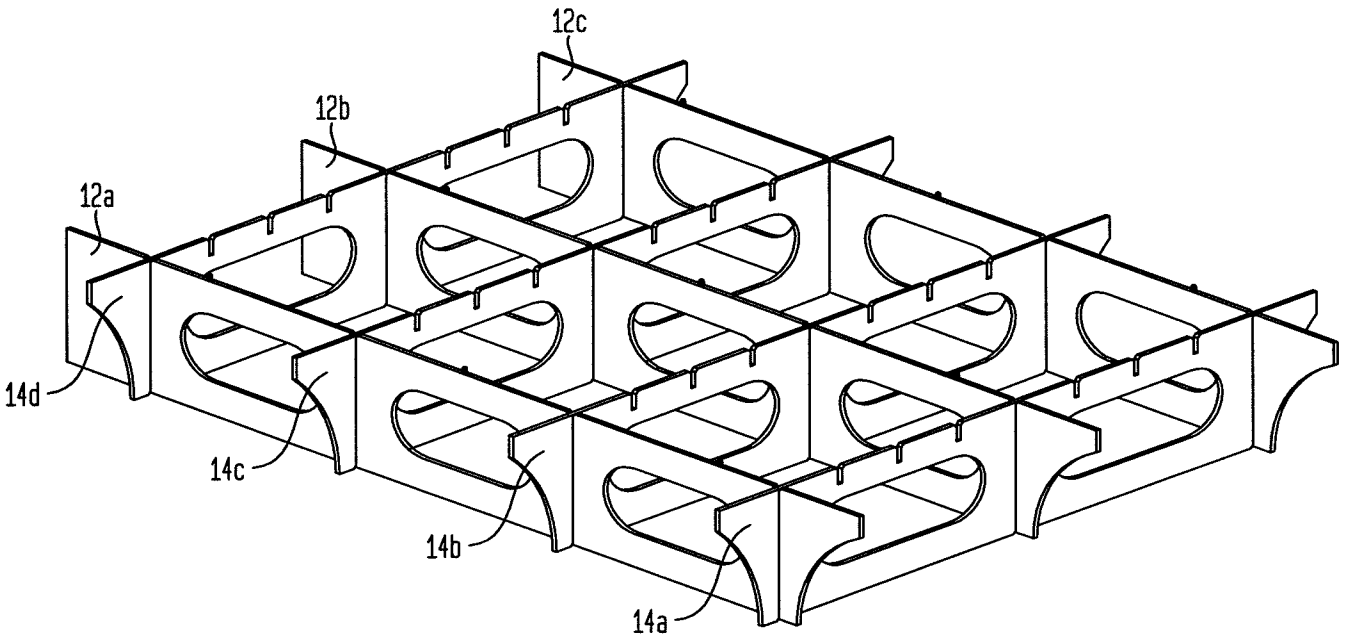
FIG. 5 illustrates the resulting egg carton-like shape of the base after steps shown in FIGS. 1-4 above are performed.
Figure 6:
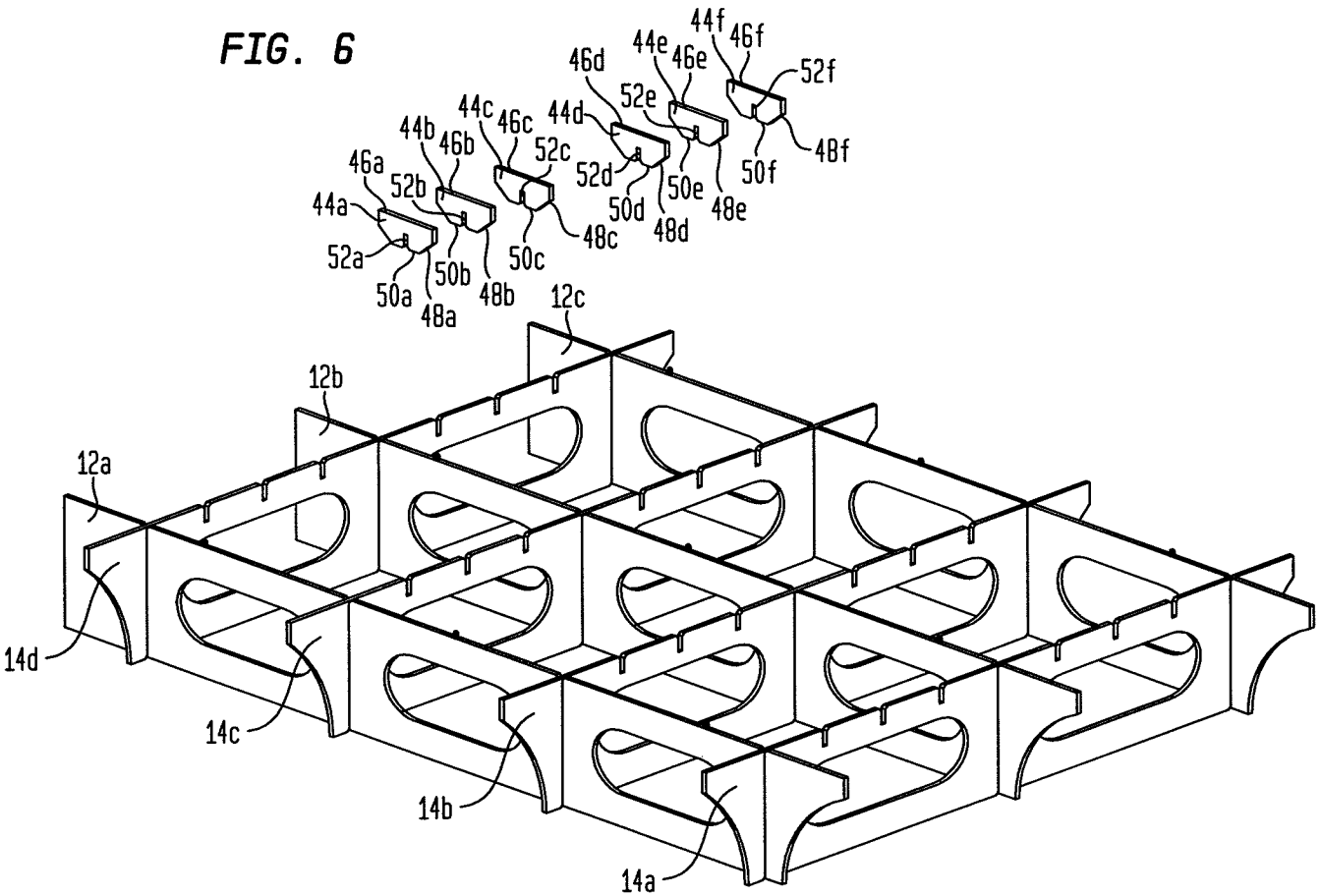
FIGS. 6-7 illustrate the manner in which deck support tabs are attached to the transverse short board sections.

The egg crate-like shape shown in FIG. 5 would preferably be used for a queen sized bed. A king size bed would probably use more supports (12*a*-12*c* and 14*a*-14*d*). Similarly, a smaller bed, such as a twin or double, would use fewer base supports (12*a*-12*c* and 14*a*-14*d*). As shown in FIG. 5 the queen size support has nine (9) threaded, male fastener attachment projections (42) facing upwardly. The threaded projections (42) are molded along with the body of the baseboard sections (12*a*-12*c* and 14*a*-14*d*) and are, therefore, permanently attached.

Figure 7:
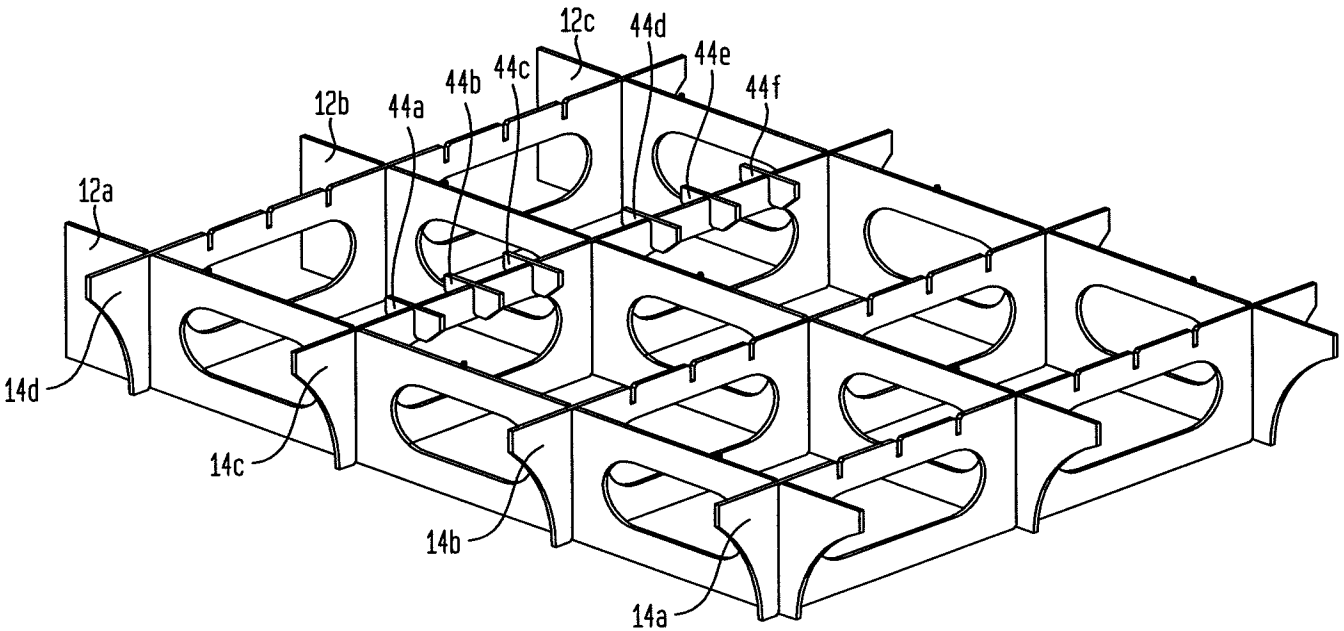
Figure 8:
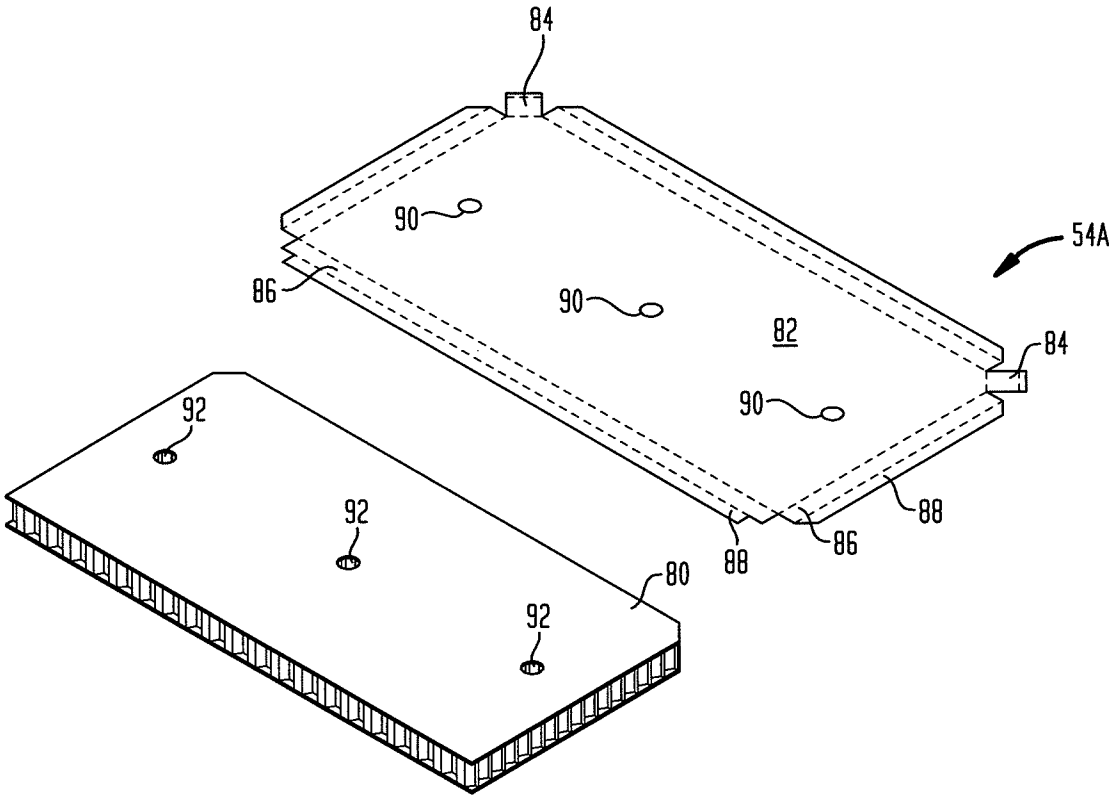
FIGS. 8-9 illustrate the cardboard core and cover that form the deck sections.
Figure 9:
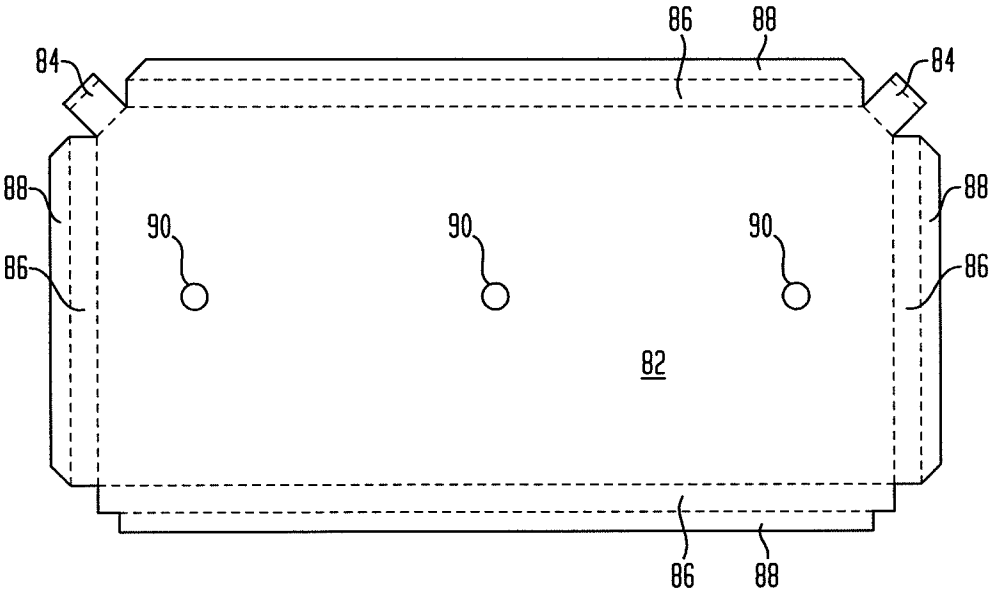

In the next step of the assembly process a plurality of mattress support tabs (44*a*-44*f*) are attached to the short base sections (14*a*-14*d*). Support tabs (44*a*-44*f*) are preferably formed from a structural foam process, similar to that used with regard to base sections (12*a*-12*c* and 14*a*-14*d*), and could comprise either polypropylene or high-density polyethylene thermoplastic materials or other thermoplastic material. Each tab (44*a*-44*f*) includes a top edge (46*a*-46*f*), a bottom edge (50*a*-50*f*), and pair of opposing sides (48*a*-48*f*). The bottom sections (50*a*-50*f*) each include a bottom slot (52*a*-52*f*) which engage the top slots (40*b*-40*c*) of the two inner shorter base support sections (14*b*-14*c*). When tabs (44*a*-44*f*) are properly inserted, the top edges (46*a*-46*f*) align in the same plane as the top edges (28*a*-28*d*) of the short base support sections (14*a*-14*d*) as shown in FIG. 7. FIG. 7 shows only six (6) of the support tabs (44*a*-44*f*) in position, however, it will be appreciated that twelve (12) slots (40*b*-40*c*) would be populated by twelve (12) support tabs (44*a*-44*f*) on the two (2) inside supports (14*b* and 14*c*) only. The purpose of the tabs (44*a*-44*f*) is to provide more support for the joints between the deck sections (54*a*-54*c*) as will be described next.

Figure 10:
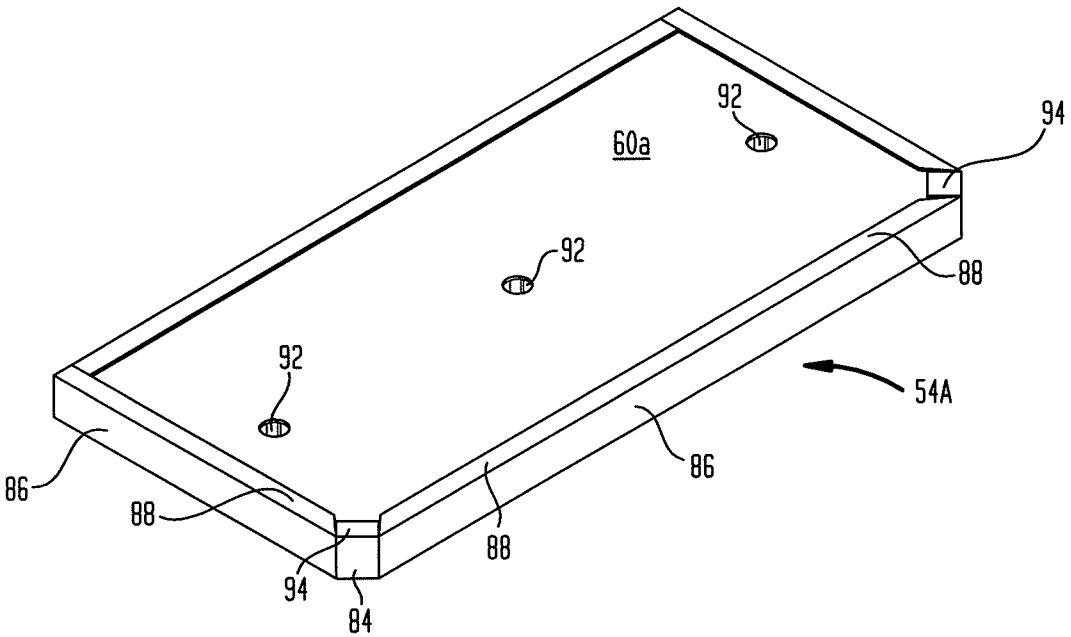
FIGS. 10-11 illustrate a bottom and top view respectively of an assembled deck section.
Figure 11:
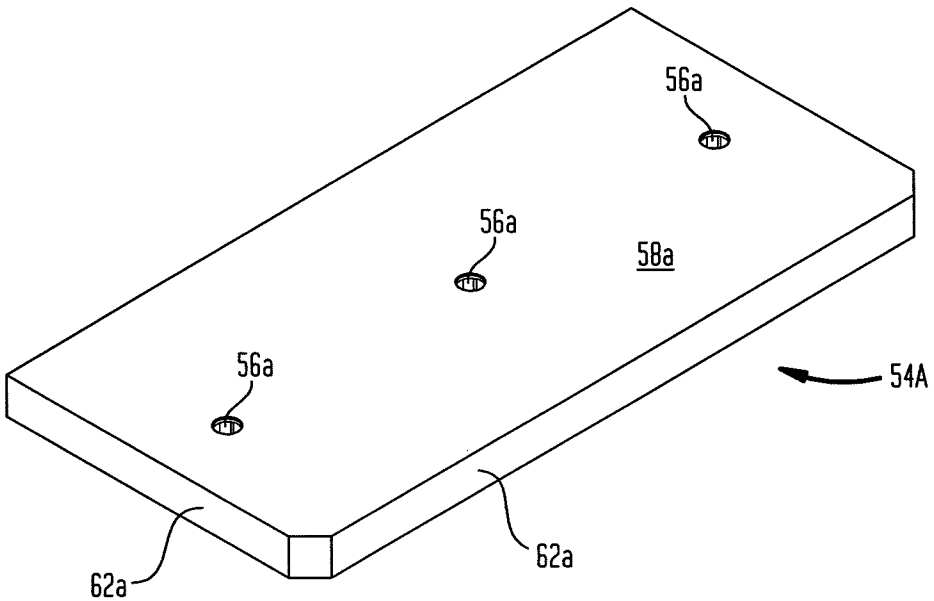

Deck sections (54*a*-54*c*) are formed in the manner illustrated in FIGS. 8-11. A 2" thick corrugated paper, honeycomb core (80) is covered by a cardboard sheet (82). Holes (92) in the cardboard core (80) correspond with holes are apertures (90) in the cover (82). Cover (82) includes four (4) side-wall sections (86) and depending sections (88) which wrap around and contact the bottom surface (60*a*-60*c*) of the deck sections (54*a*-54*c*) as shown in FIG. 10. Similarly, corner tabs (84) wrap around the edge of the cardboard core (80) and the suspended portion (94) thereof wrap around and contact the bottom (60*a*-60*c*) of the deck honeycomb core (80).

Figure 12:
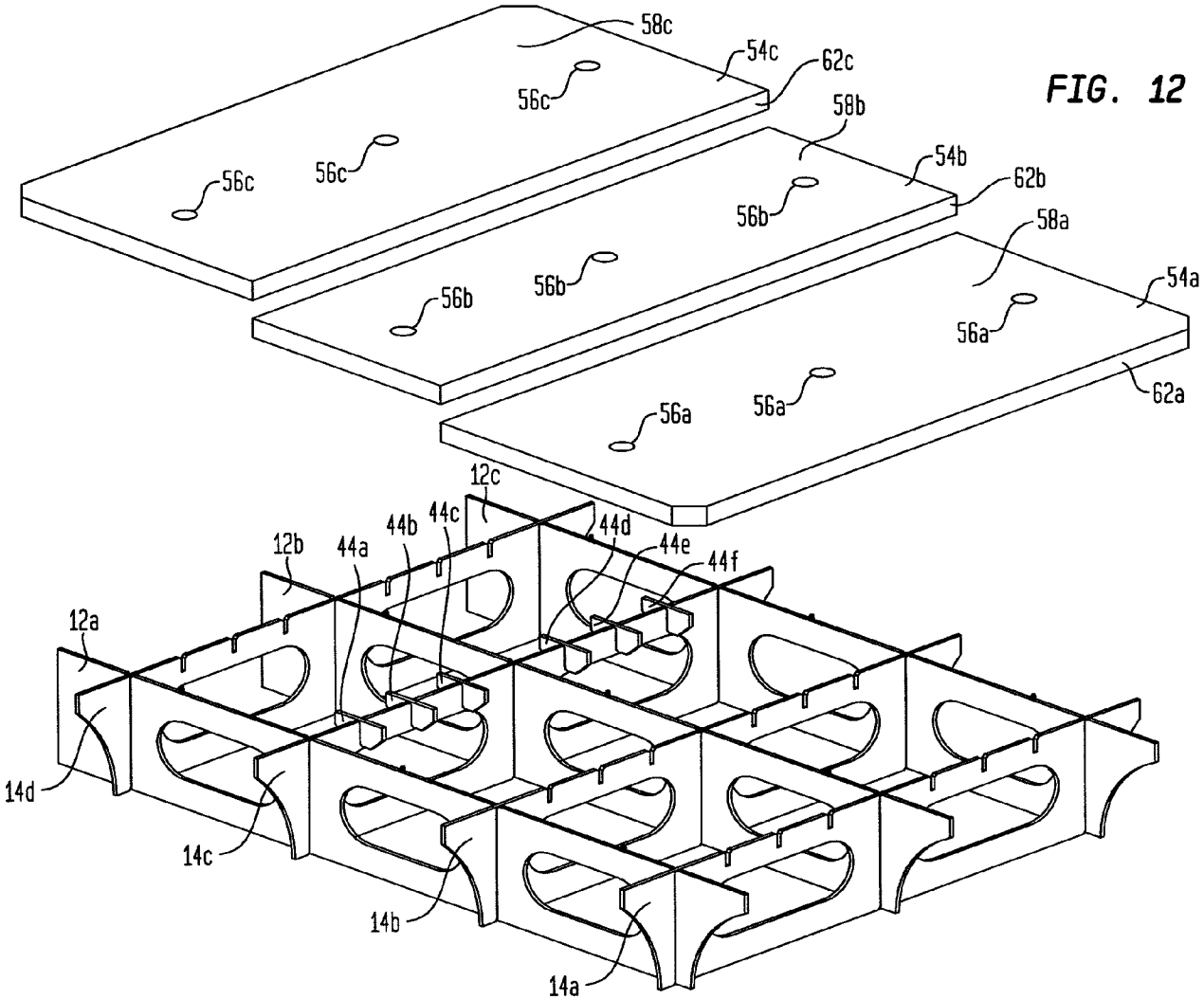
FIGS. 12-15 illustrate the manner in which the deck sections are attached to the base.
Figure 13:
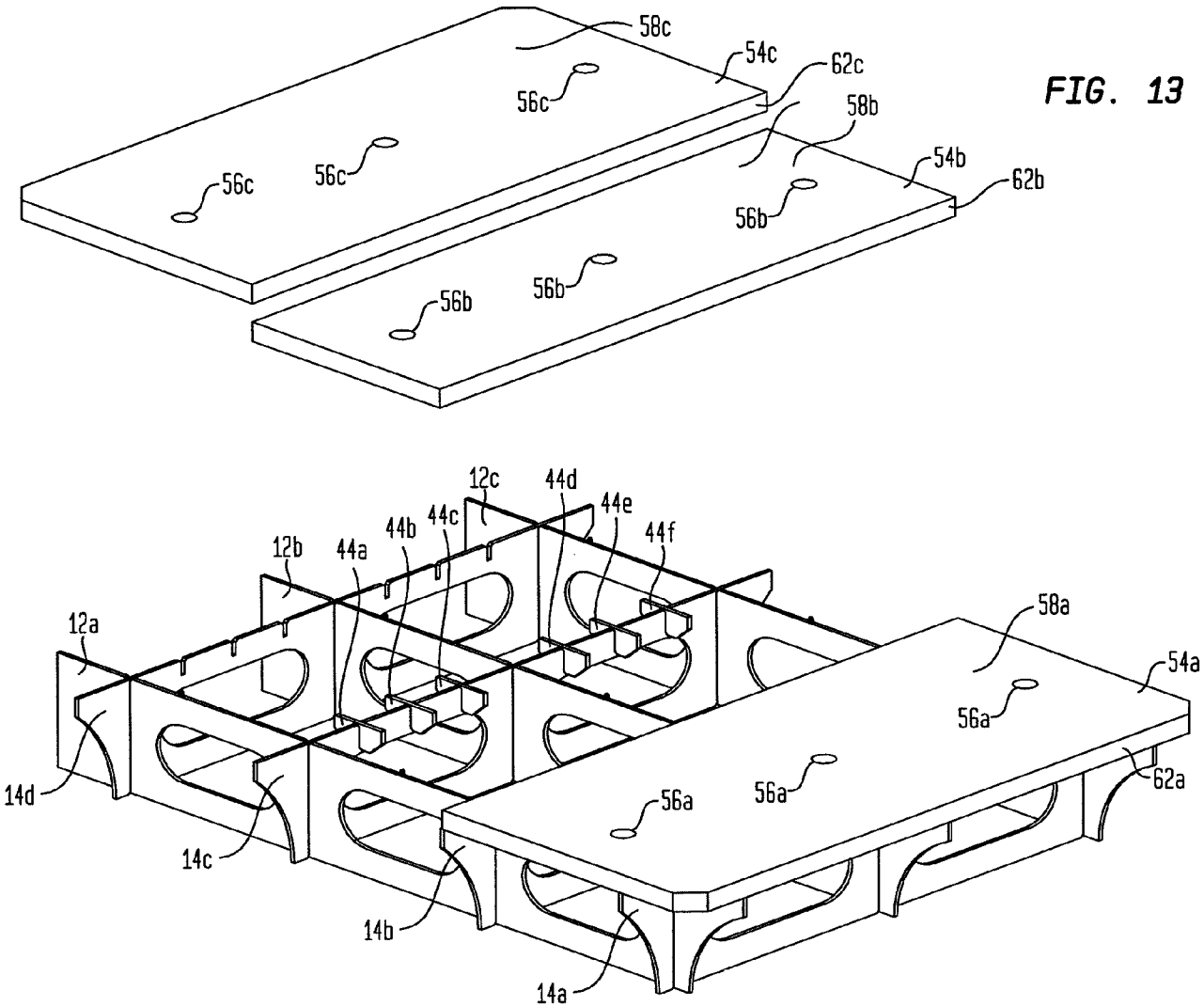
Figure 14:
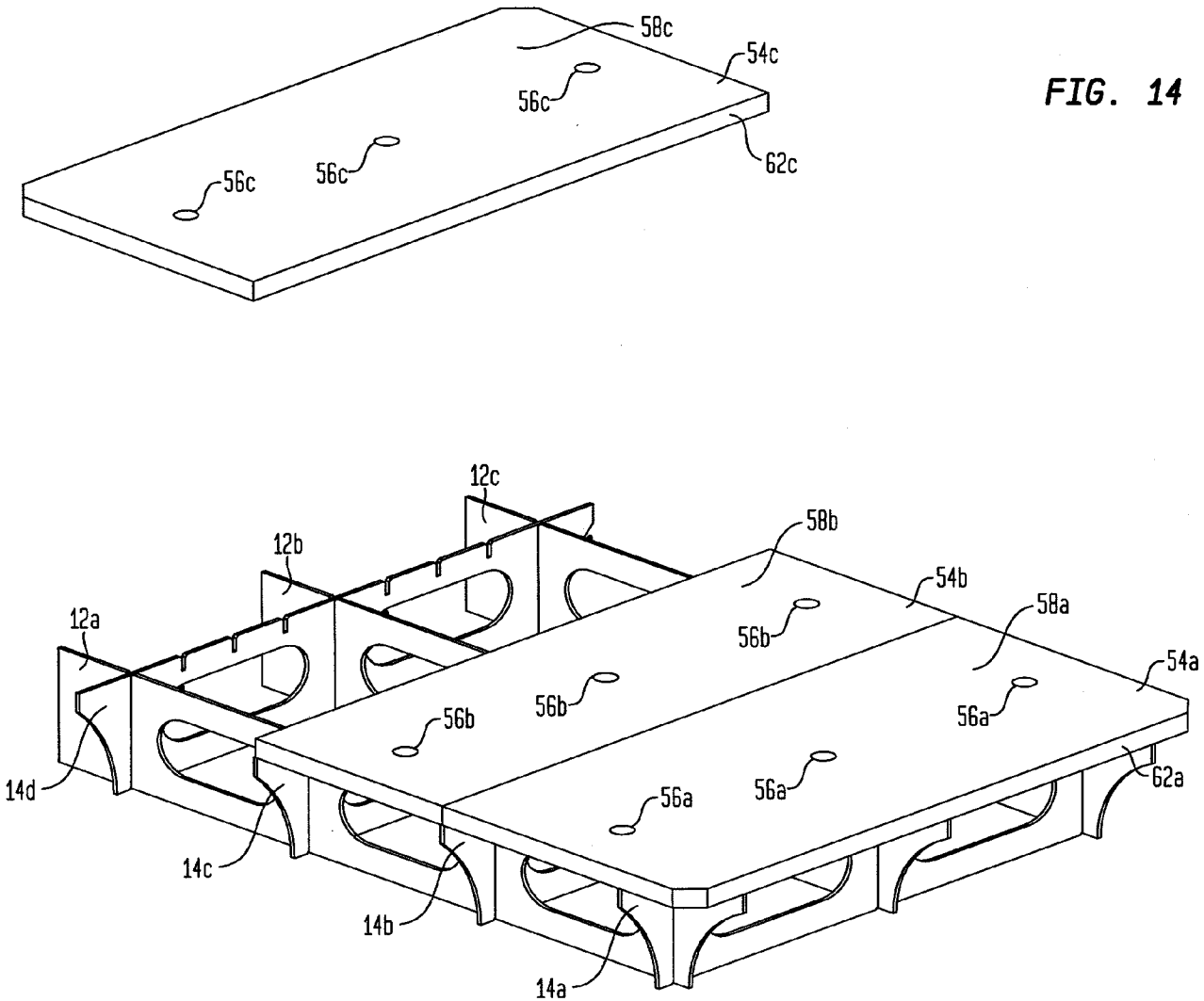
Figure 15:
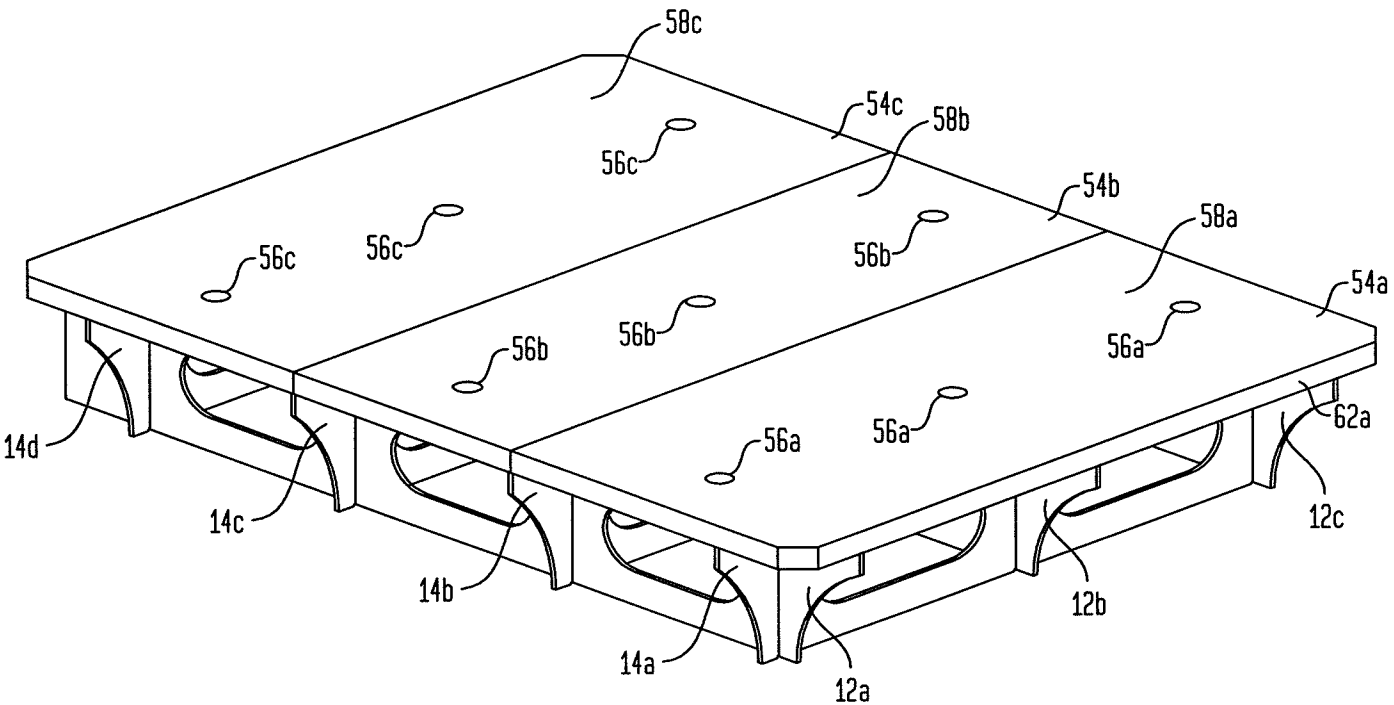

The cardboard cover (82) is preferably attached to the cardboard core (80) by means of hot melt glue or a similar adhesive. Cover (82) comprises a thin cardboard skin known as E-Flute. E-Flute cover is typically manufactured as a lay-flat with appropriate cut-outs and score lines. Cover (82) can be printed as required. The top skin of cover (82) can be standard corrugated materials or other various paper options that provide water-shedding characteristics, color options, etc. Apertures (90 and 92) are preferably approximately 2" in diameter and, when aligned form holes or apertures (56*a*-56*c*) in decks (54*a*-54*c*) as shown in FIG. 12. Cover (82) can also be made from thermoplastic sheet material. The sheet can be thermoformed to create a shallow tray-like structure that fits over the top of the honeycomb core and also covers the sides thereof.

FIG. 12 shows the deck sections (54*a*-54*c*) prior to the attachment to the egg carton-like understructure shown in FIG. 5. Three (3) deck sections (54*a*-54*c*) are shown as might be the case with a queen size bed. Fewer or lesser deck sections can be used depending upon the size of the bed that is to be assembled. Deck sections (54*a*-54*c*) include, as previously mentioned, three (3) apertures each (56*a*-56*c*) as well as a side-wall section (62*a*-62*c*). The three (3) deck sections (54*a*-54*c*) are placed on top of the egg carton-like support structure sequentially as shown in FIGS. 12-15.

Figure 18:
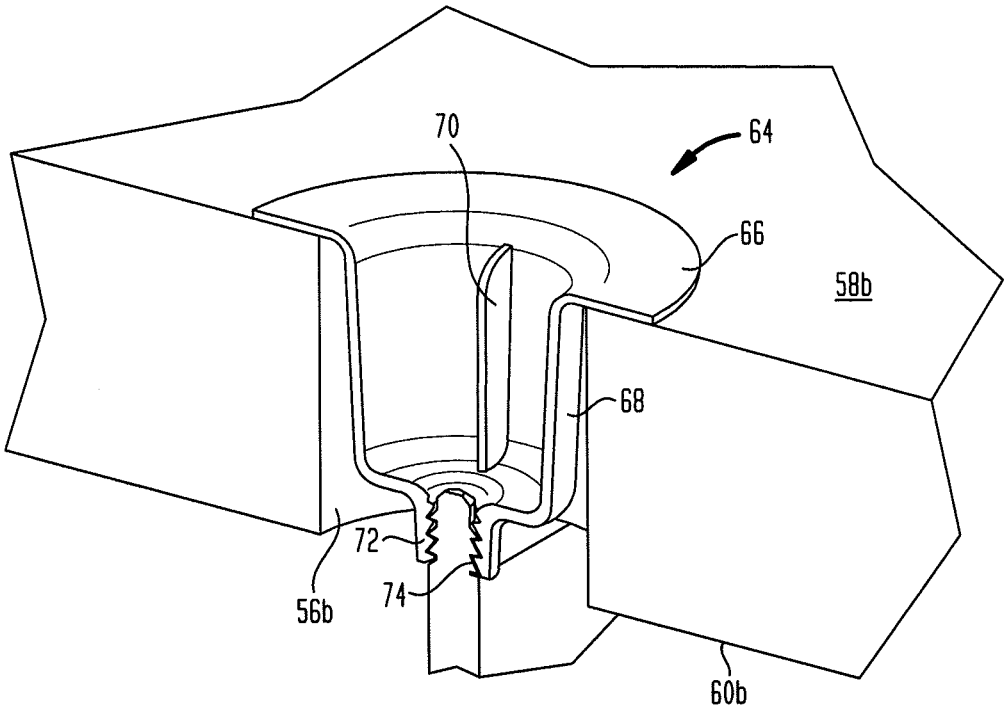
FIG. 18 is a cross sectional, detail view of a fastener nut secured to the base support structure.

After the deck sections (54*a*-54*c*) have been placed in position, they are secured to the underlying structure by means of plastic fastener nuts (64). As best seen in FIG. 18, each plastic fastener nut (64) includes an upper flange (66) that lies substantially in the plane of the top surface (58*a*-58*c*) of the deck sections (54*a*-54*c*). Each flange (64) is attached in turn to a hollow, cylindrical body (68). A fin (70) which can be manually grabbed is attached to the inner side wall of the hollow body (68). A female threaded section (72) is attached to the end of the hollow body (68) opposite from the circular flange (66). Threads (74) located on the inside of the female section (72) correspond with, and are adapted to mate with, the threads on the male projections (42*a*-42*c*) that face upwardly from the bottom support structure. Alternatively, the thread configuration could be reversed such that the female threads are in the molded support boards (12*a*-12*c*) and the male threads are part of the fastener (64). An optional cylindrical hole liner (98) shown in FIGS. 25A and 25B, including a flange (104) therein, may be placed through the deck apertures (56*a*-56*c*) and apertures (90 and 92) in order to provide additional support to the honeycomb cardboard apertures (56*a*-56*b*).

Figure 16:
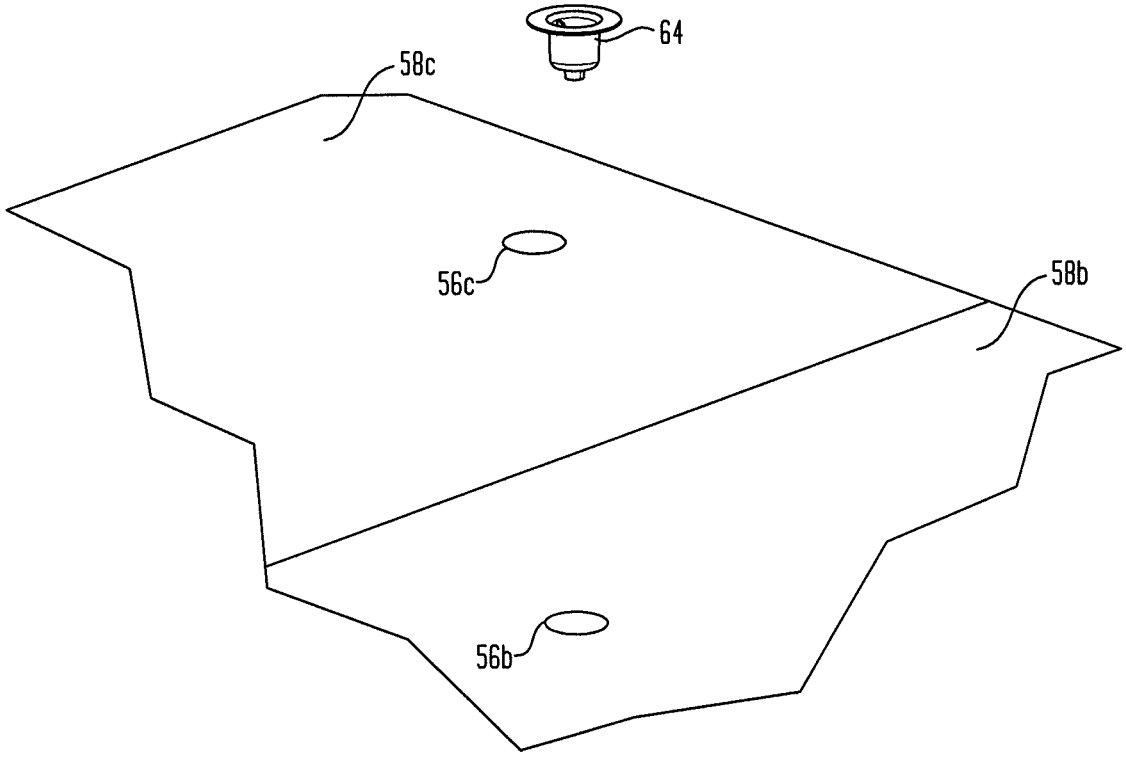
FIGS. 16-17 illustrate how a fastener nut is attached to the underlying base support structure.
Figure 17:
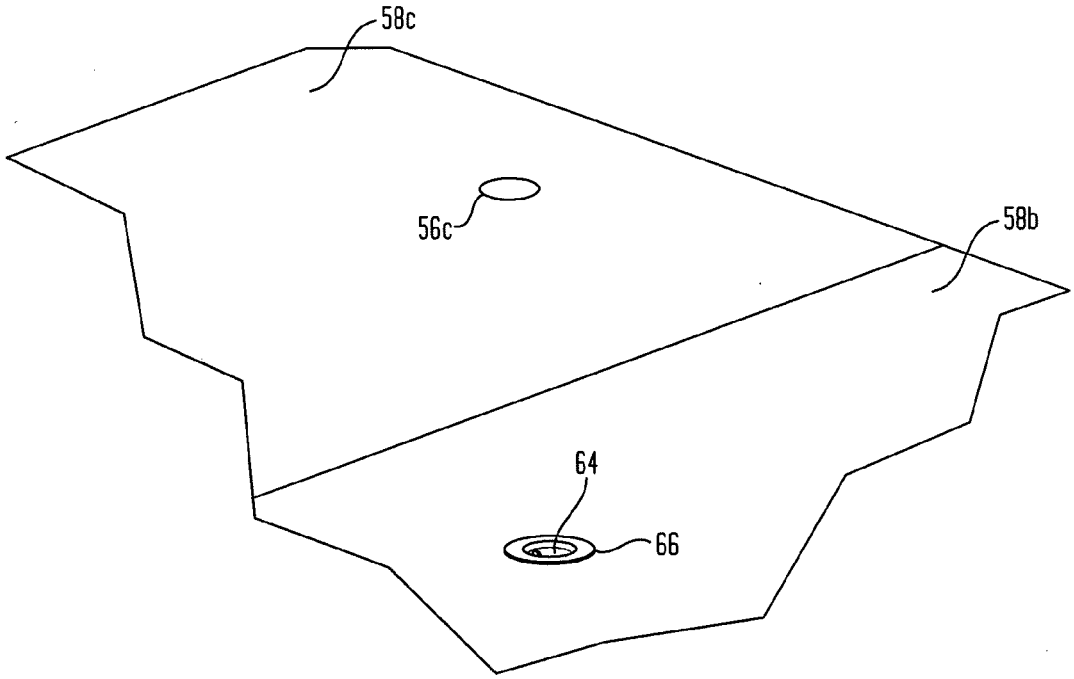

Initially, during the assembly process, the individual constructing the bedform (100) places a fastener nut (64) into an aperture (56*c*) as shown in FIG. 16. As the fastener nut (64) progresses into the aperture (56*a*-56*c*) the threads (74) of the female sections (72) come in to contact with the threads on the fastener attachment projections (42*a*-42*c*). The individual then uses his or her hands to grab or push fin (70), causing fastener (64) to rotate and the thread (74) to advance down the threads on the attachment projections (42*a*-42*c*). Continued manipulation and rotation of fastener (64) will eventually stop when the threads can no longer advance and the flange (66) is tight up against the upper surface (58*a*-58*c*). This process is repeated with the other eight (8) fasteners (64) until all three deck sections (54*a*-54*c*) have been attached to the base support structure. Note that no tools are used or are necessary to attach the deck sections (54*a*-54*c*) to the underlying support.

Figure 19:
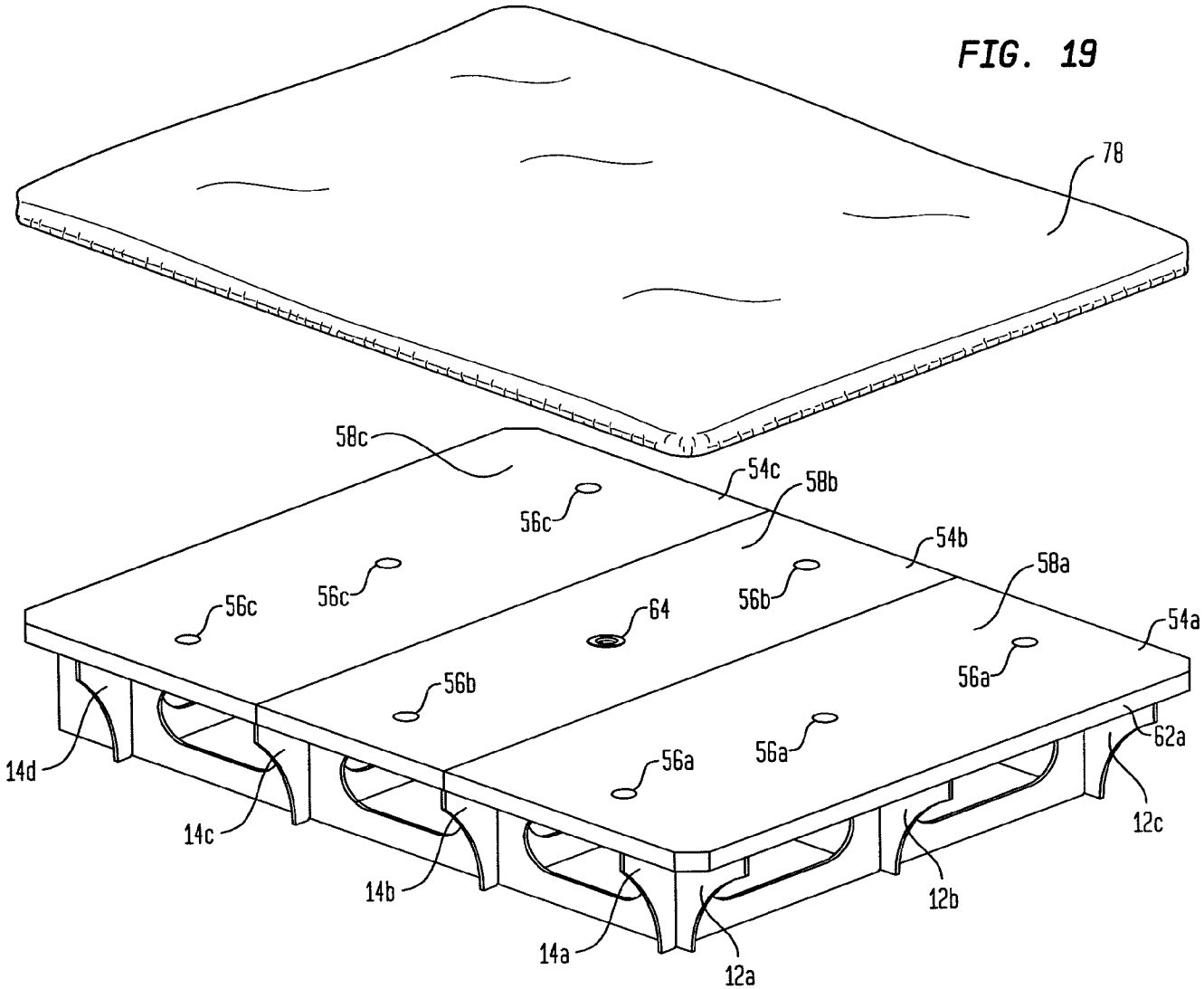
FIGS. 19-20 illustrate how a cloth cover is place over the assembled deck sections.
Figure 20:
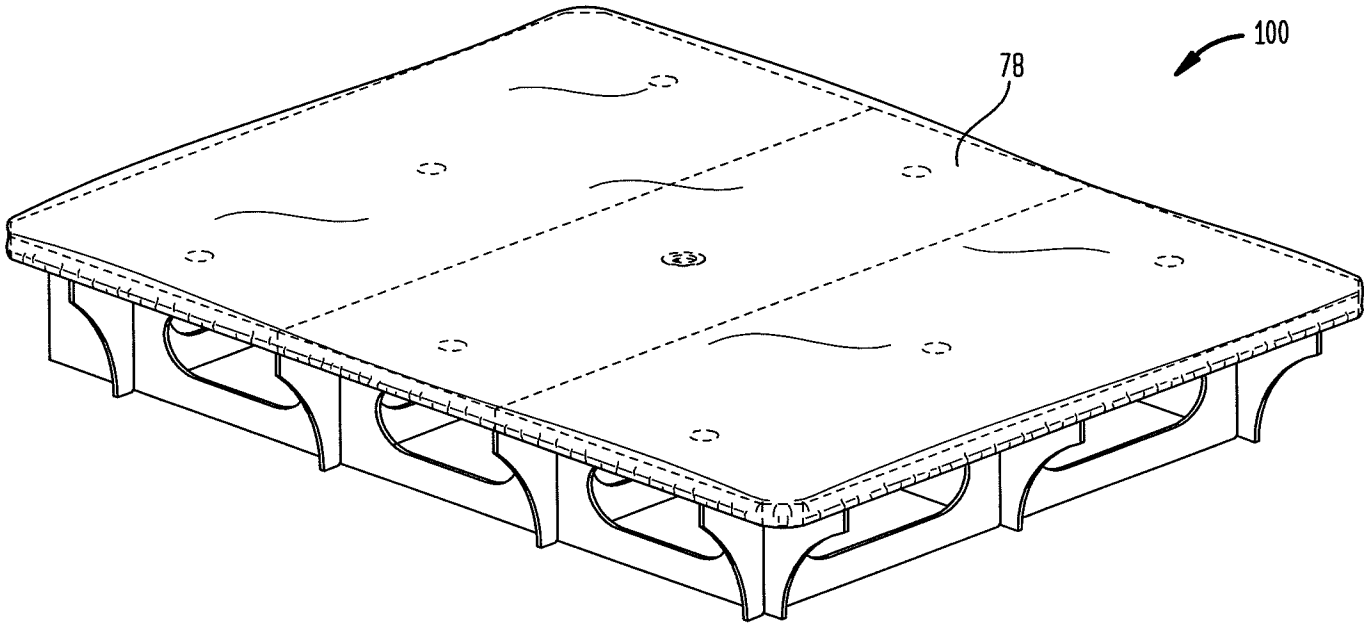
Figure 21:
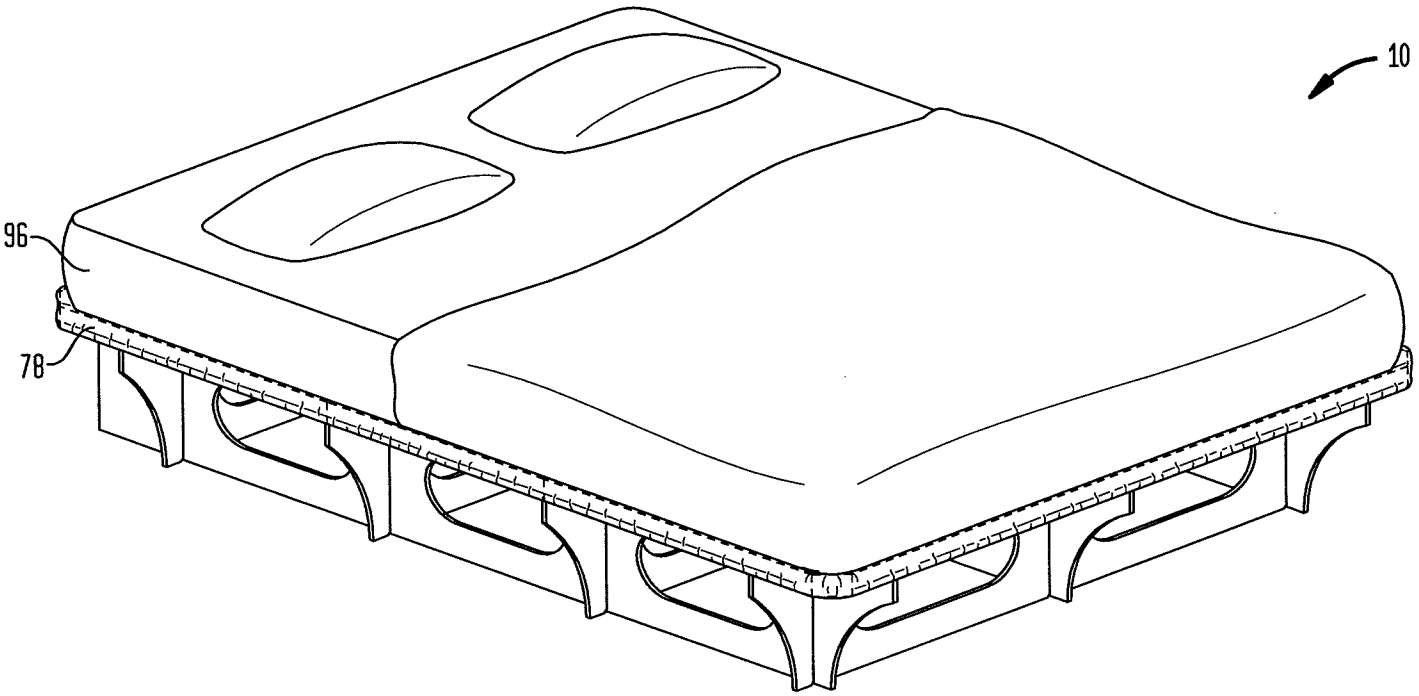
FIG. 21 illustrates a completed, ready to use bed with a mattress in position on top of the cloth cover and the deck sections.

Lastly, a cloth cover (78) as shown in FIGS. 19 and 20 is attached over the deck section (54*a*-54*c*) in the manner similar to that of a standard "bed skirt" or one that mimics a "fitted bottom sheet". The cloth cover (78) provides decoration and some level of flame retardancy as well as protection to the deck sections (54*a*-54*c*). The assembled apparatus forms a base upon which a conventional mattress (96) can be placed along with pillows, sheets, blankets, etc. to form the ultimate bed (10) as shown in FIG. 21. It should be noted that the bed (10) as constructed does not require any tools and can be erected in 5 to 6½ minutes depending upon the level of skill of the individual.

Figure 22:
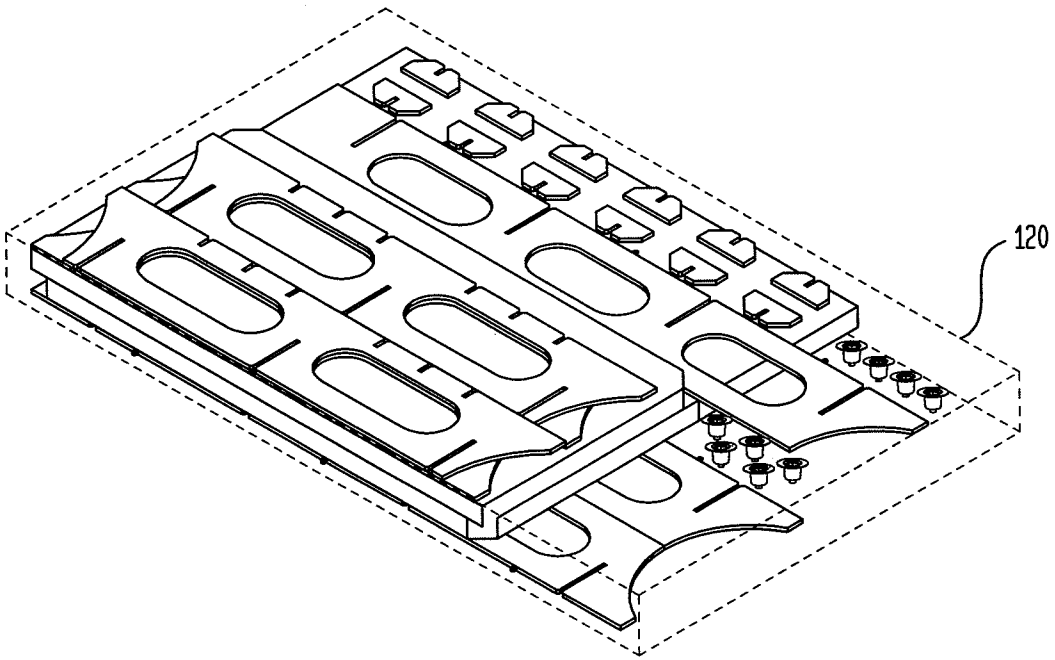
FIG. 22 shows how the entire bed form can be stored and shipped in a standard shipping carton.

All of the elements shown in FIGS. 1-20 can be contained in a single, relatively light, shipping container (120) as shown in FIG. 22.

Figure 23A:
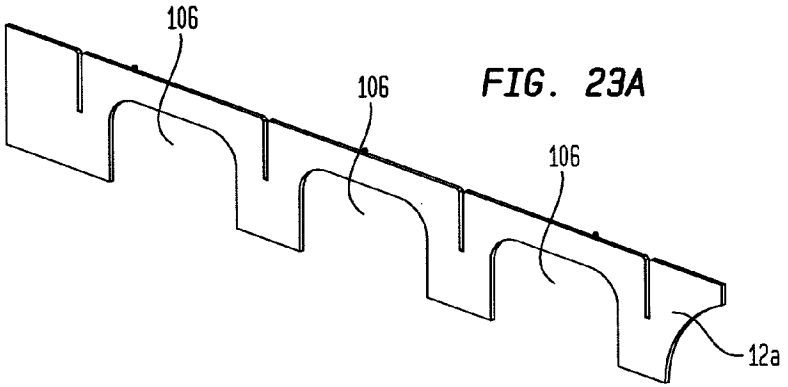
FIGS. 23A and 23 B illustrate an alternative embodiment with an aperture for storage space under the bed form.
Figure 23B:
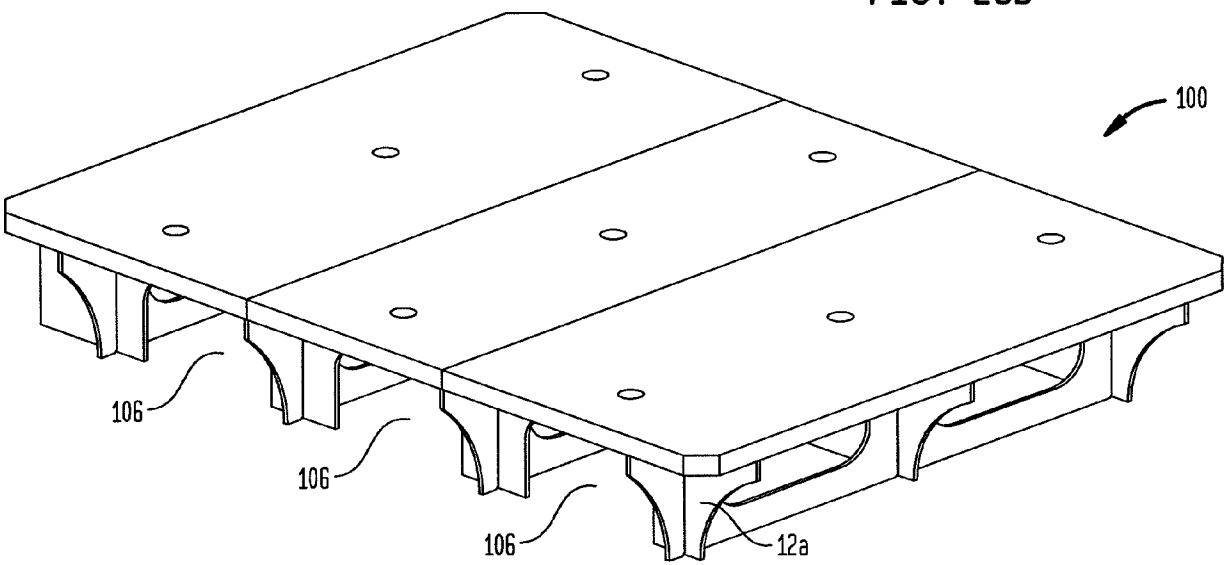

FIGS. 23A and 23B illustrate an alternative embodiment of the invention in which one or two of the long base support sections (12*a*-12*c*) include an aperture (106) that extends to the floor. When assembled into a base (100) the apertures (106) form storage areas under the bed for items such as suitcases, clothing, drawers, etc.

Figure 24A:
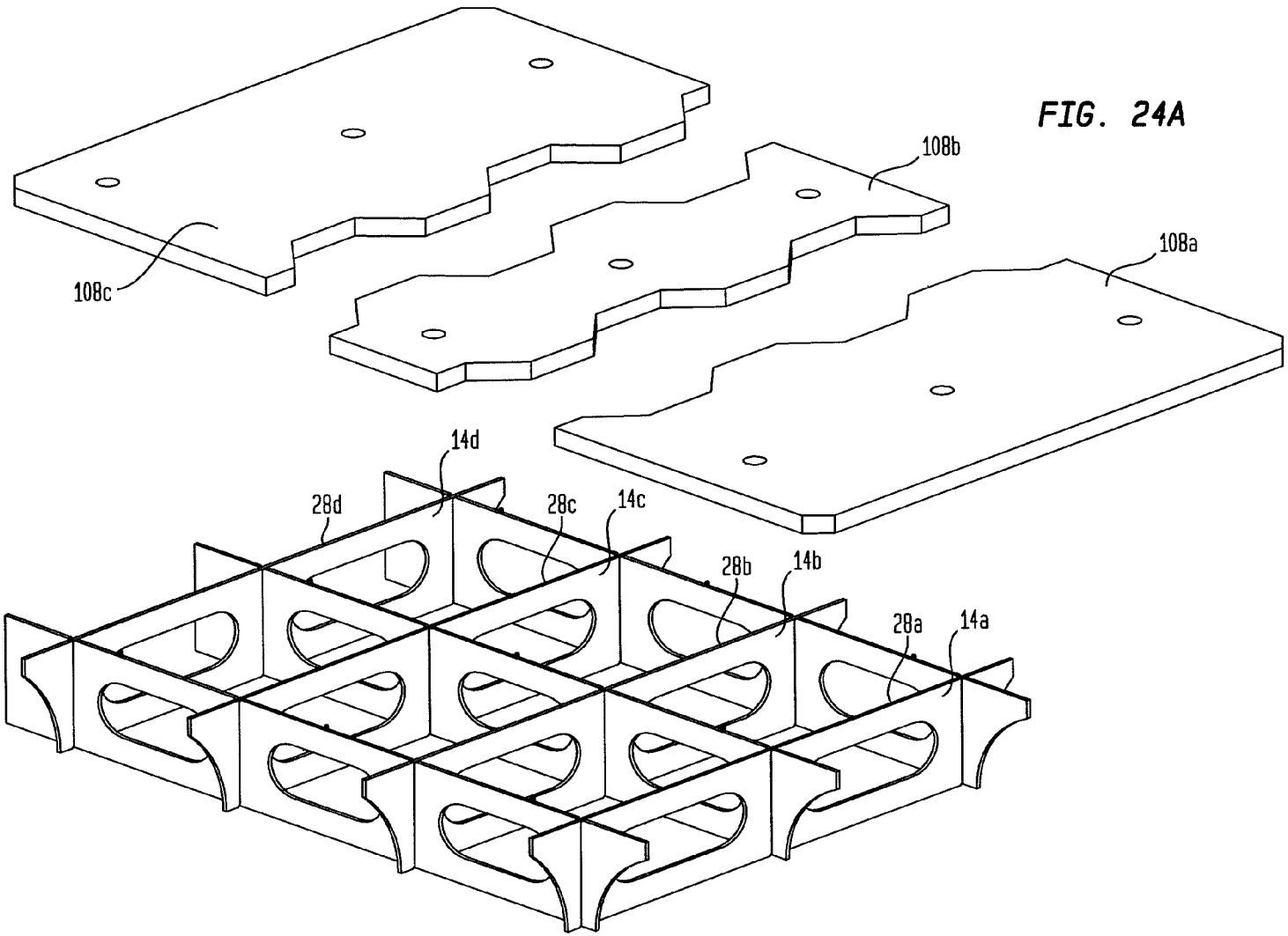
FIG. 24A illustrates an alternative embodiment with castellated deck sections.

Another alternative embodiment of the invention is illustrated in FIG. 24A. In that embodiment the deck sections (108*a*-108*c*) are castellated, i.e., have irregular abutting edges, so that the deck sections (108*a*-108*c*) are better supported by the upper edges (28*a*-28*d*) of the short base support sections (14*a*-14*c*).

Figure 24B:
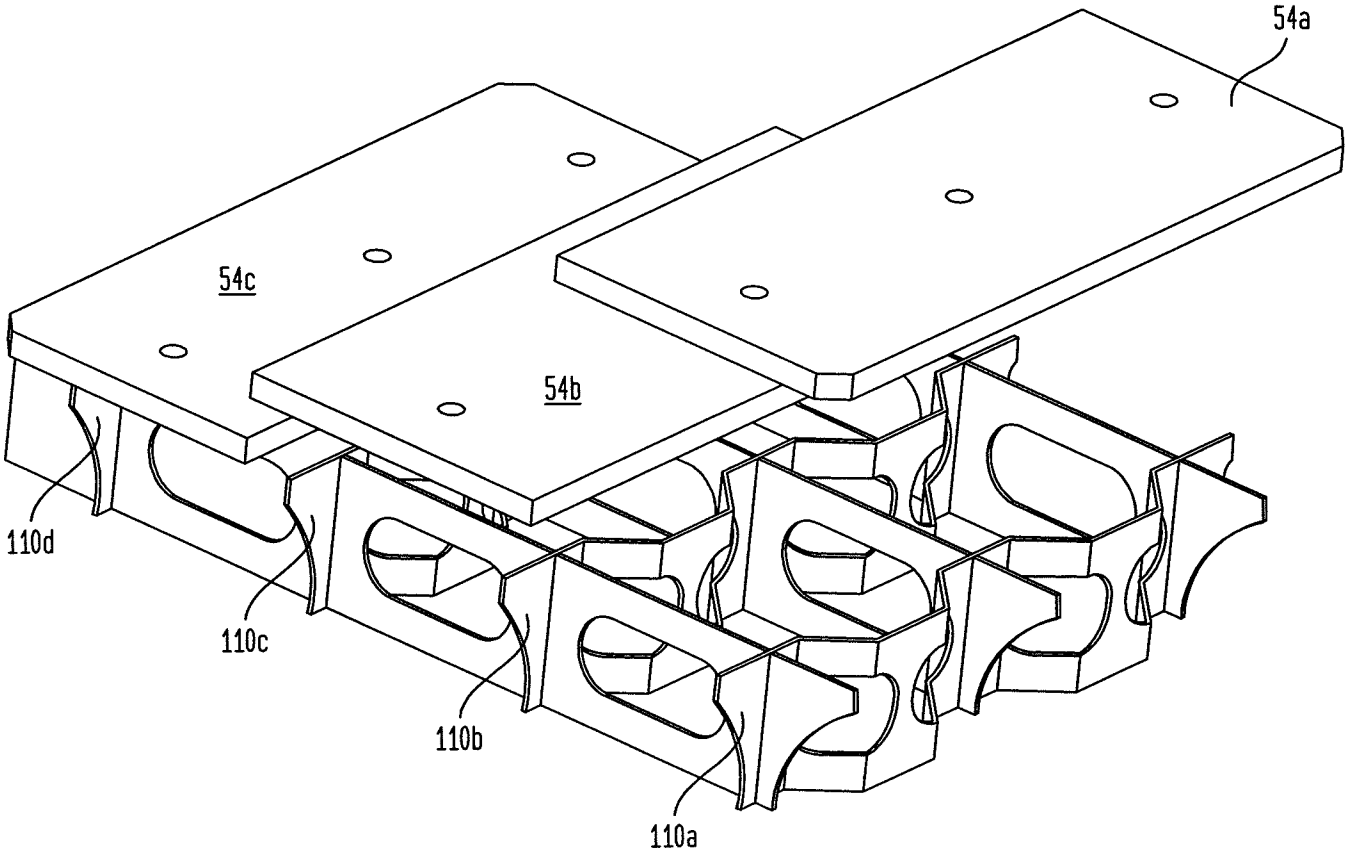
FIG. 24B illustrates an alternative embodiment with castellated base support sections.

A variation of the alternative embodiment illustrated in FIG. 24A is shown in FIG. 24B where the deck sections (54*a*-54*c*) are rectangular in the manner illustrated in FIGS. 1-20 but wherein the underlying short base support sections (110*a*-110*d*) are castellated to provide better support for the deck sections (54*a*-54*c*).

Figure 25B:
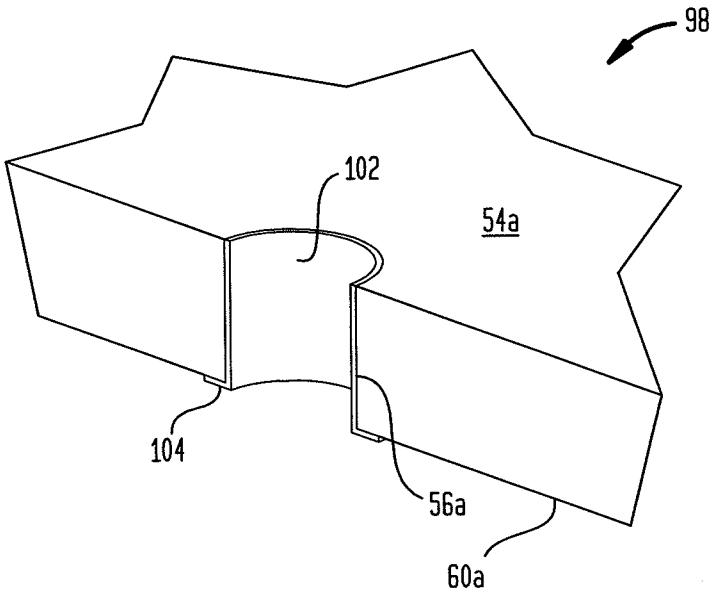
FIGS. 25A and 25B illustrate how a hole liner that can be used in combination with a fastener nut.
Figure 25A:
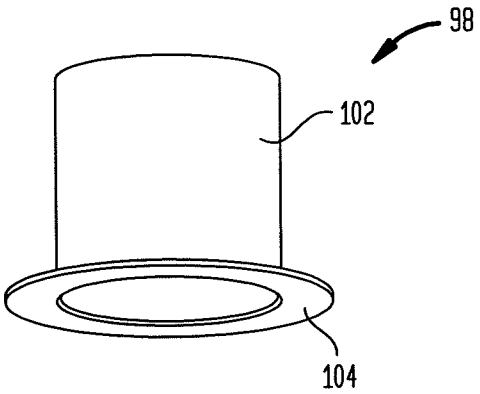

Another alternative embodiment of the invention, previously discussed, provides for a cylindrical hole liner (98) that is receivable in the holes (56*a*-56*c*) in the deck plates (54*a*-54*c*). The embodiment illustrated in FIGS. 25A and 25B calls for a cylindrical, cardboard stock hole liner (98) including a hollow body sidewall portion (102) and a lower flange (104). As seen in FIG. 25B the hole liner (98) is preferably inserted from the bottom (60*a*-60*c*) of the deck section (54*a*-54*c*) so that the flange (104) abuts the bottom surface (60*a*-60*c*) when the hole liner (98) is properly in position in hole (56*a*). In this manner the side walls (102) of the hole liner (98) provide additional support to the cardboard honeycomb core section (80) of the deck sections (54*a*-54*c*). The plastic nut fastener (64) is placed into the aperture formed by the sidewalls (102) and screwed into the projecting male threaded attachment sections (42*a*-42*c*) in the manner previously described. This also helps to more firmly attach the deck sections (54*a*-54*c*) to the underlying base support structure because the flange (104) of the hole liner (98) is located opposite from the flange (66) on the plastic nuts (64) and in this fashion effectively squeeze the deck plate (54*a*-54*c*) between flanges (66 and 104) thereby better securing the deck sections (54*a*-54*c*) to the underlying support structure. The hole liner (98) is preferably made of rigid cardboard stock but could also be made of an appropriate plastic material.

Other alternatives of the present invention are possible as well. For example, a queen size bed is illustrated in the preferred embodiment of the invention (10) as seen in FIGS. 1-20. In this embodiment there are three long sections (12*a*-12*c*) and four shorter base support sections (14*a*-14*d*). A larger bed, for example a king size bed, might require more long and short sections, whereas a shorter bed, for example a double or twin, might required fewer long and short sections. The deck sections (54*a*-54*c*) are described as having a cardboard, honeycomb core (80) approximately 2" thick. Clearly the thickness of the core (80) could vary significantly, perhaps in the range of 1"-3". Other light weight materials could be used too, such as structural foam, other plastics, etc. Similarly the materials that comprise the base sections (12*a*-12*c* and 14*a*-14*d*), while described as being made preferably of structural foam, could be made of other recycled material such as wood, cardboard, plastic and the like.

The invention (10), in total has a number of significant unique, important features. First, it can be made entirely from recycled materials, which means that when the bed (10) is constructed it utilizes materials that would otherwise fill our landfills. Second, all of the materials can be shipped in a light-weight shipping container and sent to a hotel or dormitory where it can be used. Third, and very importantly, the entire assembly can be put together without the use of tools. A typical user can totally erect the bed platform in a period of 5-6½ minutes. Likewise, the entire assembly can be disassembled in a similar amount of time and either stored in its original packaging (120) or disposed of as required.

Another alternative embodiment of the invention (200) is shown in FIGS. 26A-26D. Alternative embodiment (200) differs from the previously described embodiments in that it includes a pair of ribs (202A) and (202B) that replace tabs (44A-44F) and it further includes four top panels (212A-212D) as opposed to the three top panels shown in the other embodiments.

Figure 26A:
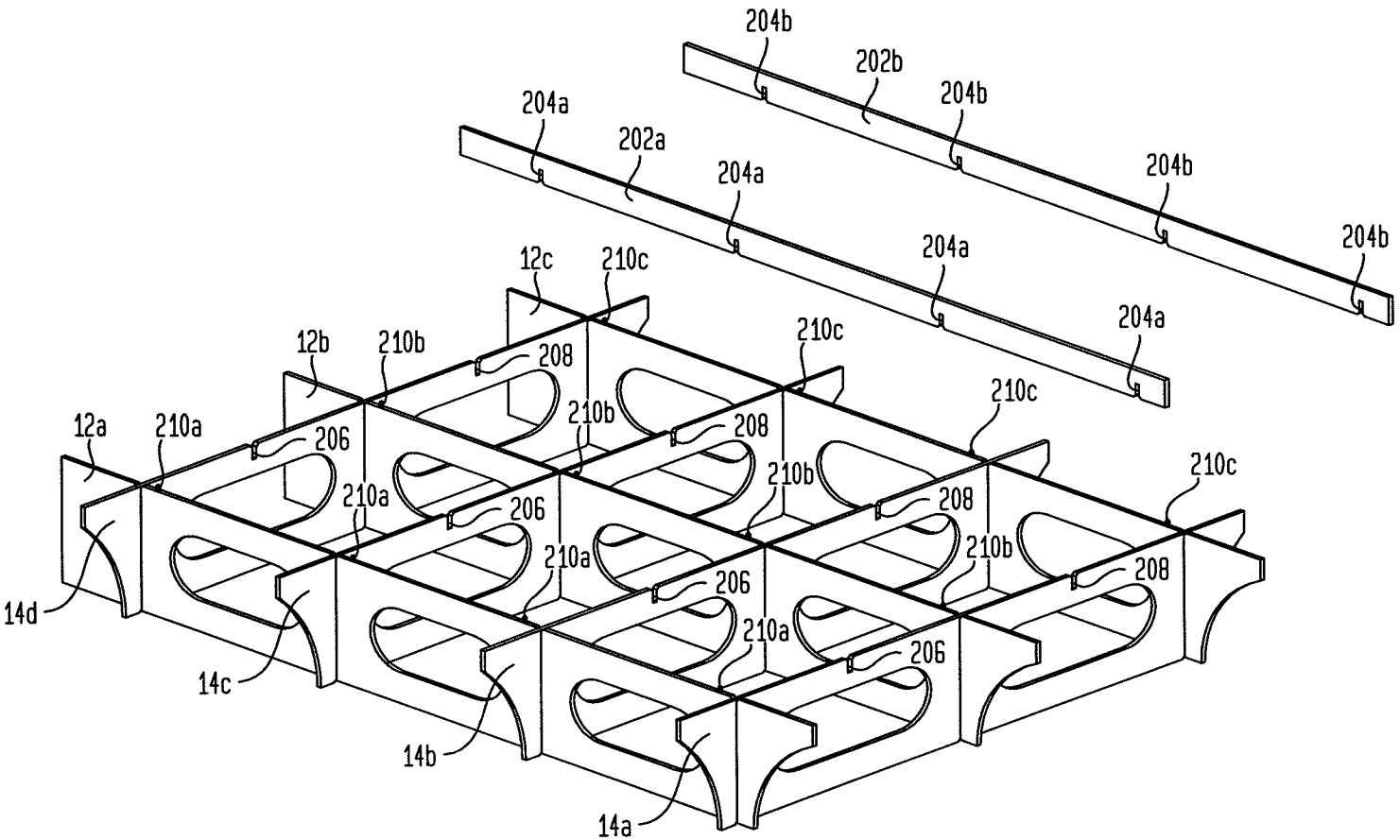
FIG. 26A is a partial exploded view of an alternative embodiment of the invention in which a pair of ribs replace the tabs formally used to support the top panels or sections.

FIG. 26A shows the basic platform structure in which the three longitudinal base sections (12A), (12B) and (12C) mate with the four horizontal sections (14A), (14B), (14C) and (14D). The horizontal sections (14A), (14B), (14C) and (14D) include a pair of notches (206) and (208) which engage with notches (204A) and (204B) on ribs (202A) and (202B) respectively. The long or vertical sections (12A), (12B) and (12C) each include four threaded projections (210A), (210B) and (210C).

Figure 26B:
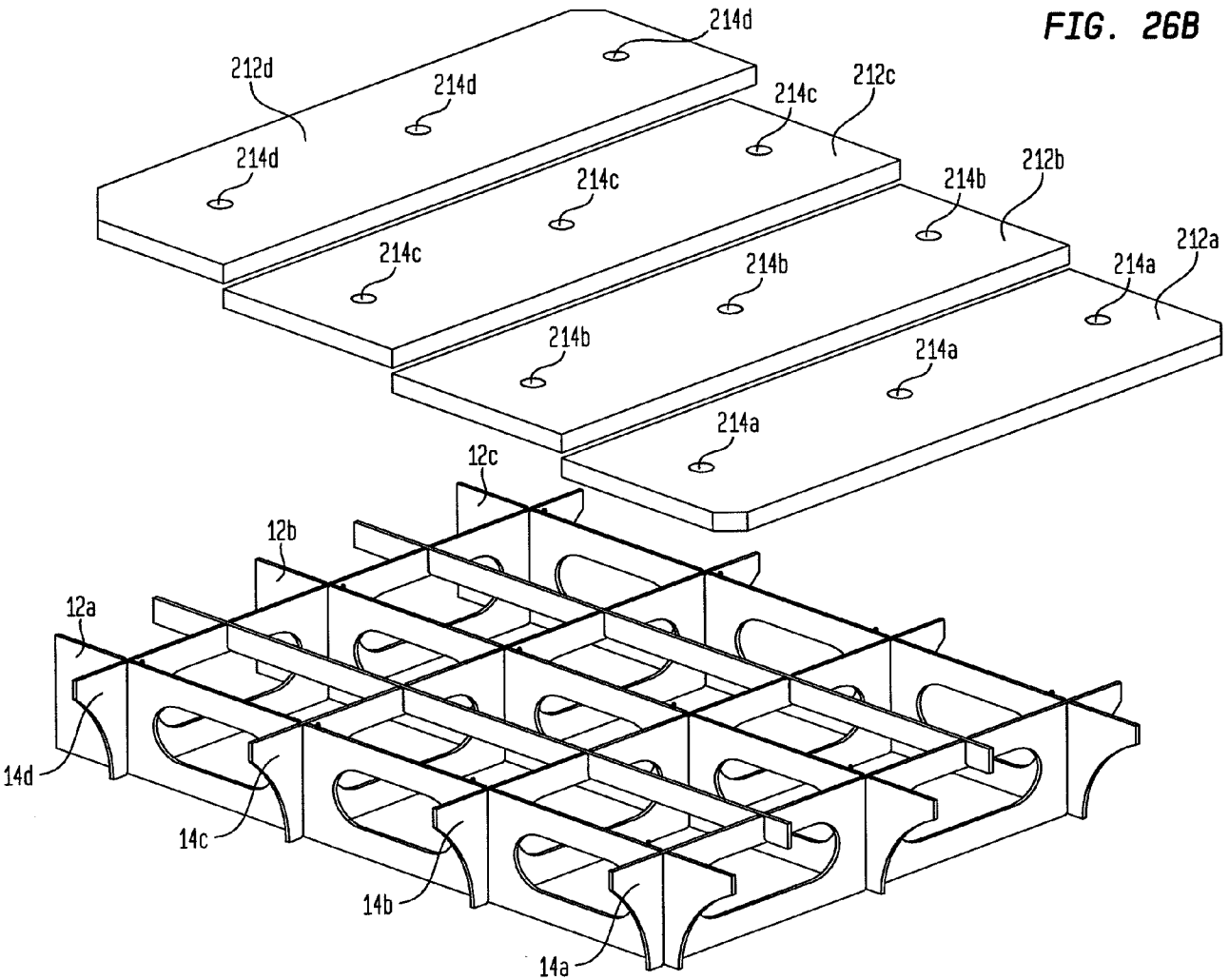
FIG. 26B is another exploded view of the alternative embodiment shown in FIG. 26A wherein four top panels replace the previous three top panels.

FIG. 26B is an exploded view which illustrates the manner in which the four top panels (212A), (212B), (212C) and (212D) mate with the threaded projections (210A), (210B) and (210C) respectively. The first top panel (212A) includes three apertures (214A); the second top panel (212B) includes three apertures (214B); the third top panel (212C) includes three apertures (214C); and, the fourth top panel (212D) includes three apertures (214D) that each receive in them one of the fasteners (64) in a manner similar to that described with respect to the previous embodiments.

Figure 26C:
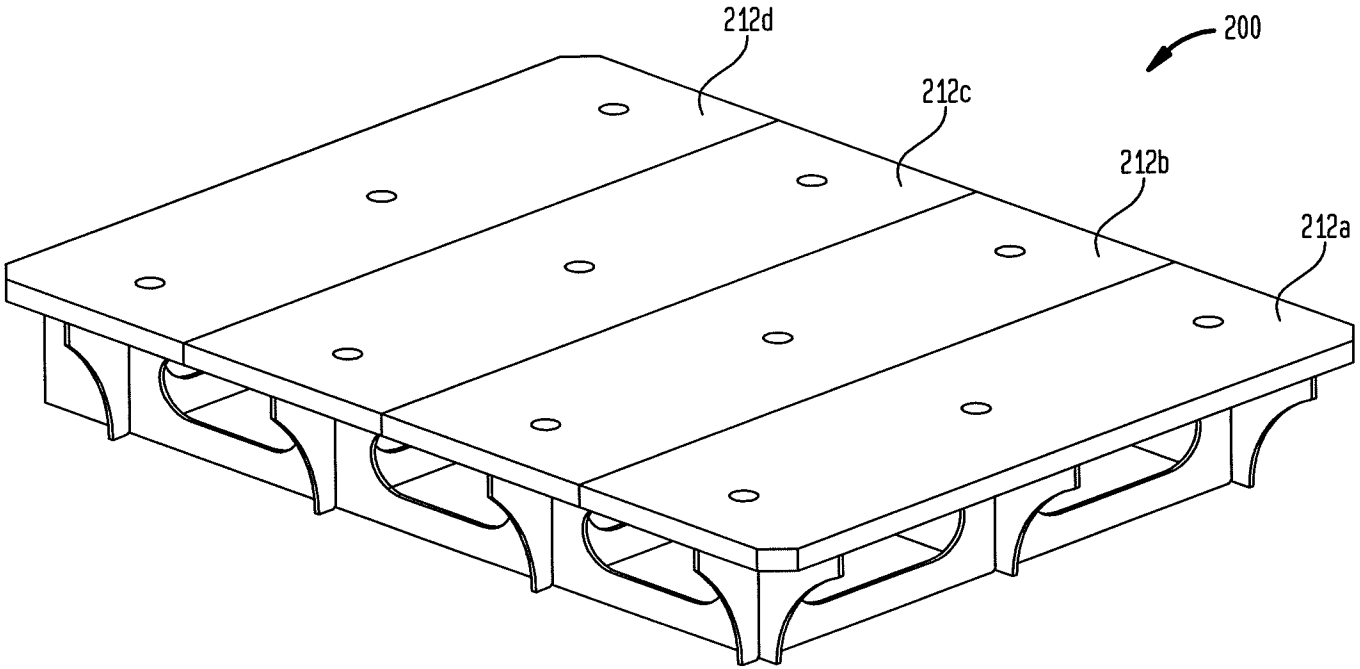
FIG. 26C illustrates the alternative embodiment shown in FIGS. 26A and 26B with the top panels attached to the underlying frame.

FIG. 26C shows the alternative embodiment of the invention (200) with the four top panels (212A), (212B), (212C) and (212D) fastened to the under frame.

Figure 26D:
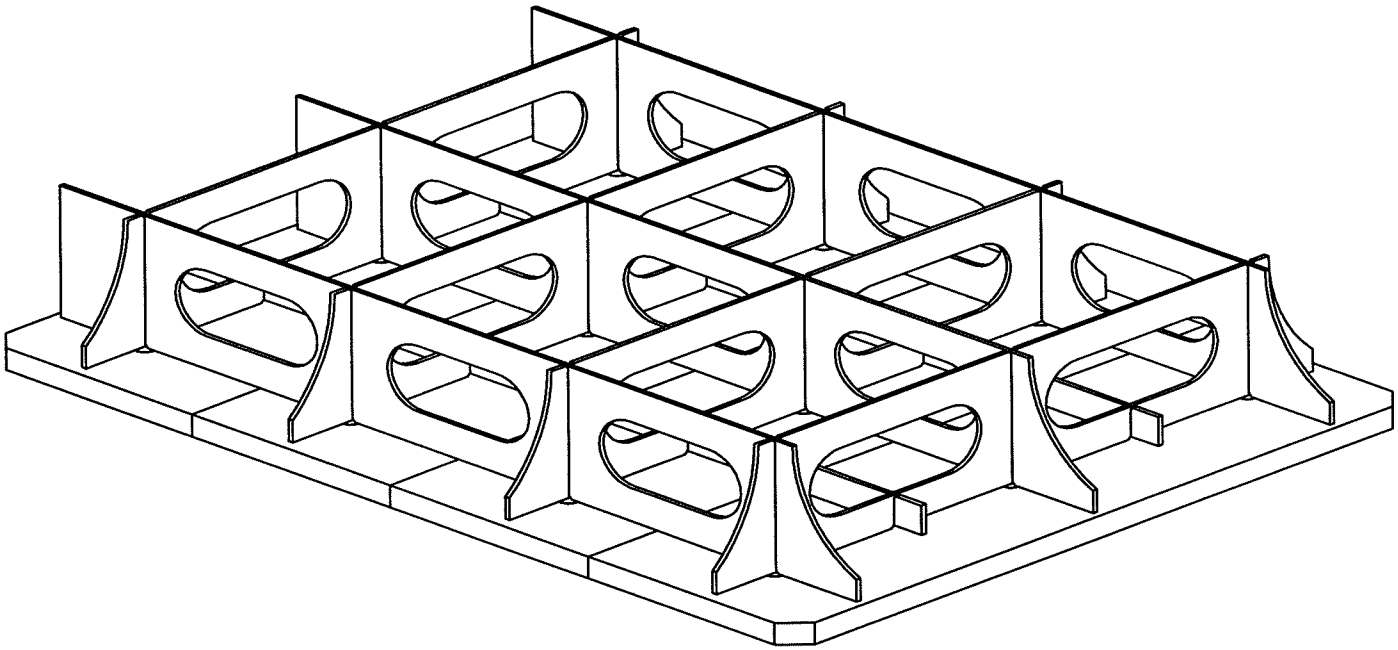
FIG. 26D illustrates the assembled alternative embodiment of FIGS. 26A-26C as seen in perspective view from below the assembled unit.

FIG. 26D illustrates the alternative embodiment of the invention (200) in its assembled state as seen from below.

The alternative embodiment (200) has several advantages over the other embodiments set forth in this disclosure. First, the width of the four top panels or sections (212A-212D) is narrower than the three top panel embodiments (54A, 54B and 54C). This permits the entire assembly to be shipped in a narrower carton thereby decreasing shipping costs and storage costs. Second, replacing tabs (44A-44F) with two long ribs (202A) and (202B) decreases the number of pieces that have to be made thereby decreasing the overall cost without sacrificing strength.

Another alternative embodiment of the invention (10) would be to reverse the male and female parts of the fastener system. In this alternative embodiment, the threaded male projections (42*a*-42*c*) on the cross pieces (12*a*-12*c* and 14*a*-14*d*) would be replaced with threaded female apertures and the threaded female section (72) at the end of the screw-in fastener (64) would be replaced with a threaded male projection. The assembly steps would be identical to what was previously described with respect to the preferred embodiment except that the fastener would be screwed into the cross pieces rather that then the other way around.

While the invention has been described with reference to the preferred embodiment (10) thereof it, will be appreciated by those of ordinary skill in the art that modifications can be made to the elements that comprise the invention without departing from the spirit of the invention as a whole.

The invention claimed is:

1. A bed platform apparatus for supporting a mattress comprising:

a plurality of first base sections each having a first and a second surface and top and bottom edges and a first and a second side, the top edge having a plurality of slots therein and further including a plurality of fastener engagement means located along said top edge, wherein said fastener engagement means located on said top edge of said first base section comprises at least one projection having threads on the exterior thereof;

a plurality of second base sections each having a first and a second surface and top and bottom edges and a first and a second side, said bottom edge having a plurality of slots therein, wherein when said first and second base section are positioned to cross each other and said slots in the top edge of said first base sections engage the slots in the bottom edge of said second base sections, said first and base sections form a base;

a plurality of deck sections each having a top surface, a bottom surface and sides, wherein said deck sections include at least one aperture therein through which a fastener means can pass to engage said fastener engagement means;

a plurality of slots located along the top edge of said second base section;

a plurality of deck support tabs each having at least one slot therein for engaging at least one slot in the top edge of said second base sections, wherein when said deck support tabs are attached to selected second sections they provide additional support for the abutting sides of said deck sections;

a plurality of fastener means for attaching said deck sections to said fastener engagement means on the top edge of said first base sections, said fastener means comprising:

a hollow body section having a first end and a second end and an interior side wall;

a flange section located at said first end of said bottom section;

an attachment section located at said second end of said bottom section for engaging said fastener engagement means located on said top edge of said first base sections; and, a fin attached to the interior side wall of said hollow body, wherein said attachment section of said fastener means included an aperture therein having interior threads therein for mating with the exterior threads of said fastener engagement means, and further wherein when said fastener means is passed through said aperture in at least one of said deck sections and when said fastener means is subsequently rotated, the interior threads of said fastener means engage the exterior threads of said fastener engagement means so that the continued rotation of said fastener means brings said flange section into contact with the top surface of said deck section thereby securing said deck section to said base, and wherein the hand of an individual can contact said fin and rotate said fastener means to cause said fastener means to securely attach said deck section to said base without the need of a tool.

2. The apparatus of claim 1 further comprising:

a plurality holes in said first and second sections to reduce the weight of said base.

3. The apparatus of claim 1 wherein said first and second base sections are fonned from structurally molded plastic foam.

4. The apparatus of claim 1 wherein said fastener engagement means is an integrally molded part of said first base section.

5. The apparatus of claim 1 wherein said deck sections further comprise:

a honeycomb-like cardboard core; and, a cover that covers the top surface of said deck section, said sides of said deck section and at least part of said bottom surface of said deck section.

6. The apparatus of claim 5 wherein said deck section cover further comprises a top surface, attached sides and corner tabs, and bottom surface portions connected to said sides and corner tabs for attachment to said bottom surface, wherein said cover may be attached to said cardboard core with glue so that it covers substantially all of the top surface and said side surfaces of said deck core.

7. The apparatus of claim 6 wherein said deck cover comprises a cardboard material.

8. The apparatus of claim 7 wherein said structural foam core of said deck sections comprises a thermoplastic material.

9. The apparatus of claim 8 further comprising:

a cylindrical liner receivable in said aperture in said deck section for providing additional structural strength to said cardboard core.

10. The apparatus of claim 9 further comprising:

a formed cloth cover to cover and protect said deck sections when said apparatus is assembled.

11. The apparatus of claim 10 wherein said deck sections are rectangular in shape.

12. The apparatus of claim 11 wherein at least one of said first and second sides of said first and second base sections is curved so that an individual is less likely to stub a toe on the assembled bed form.

13. The apparatus of claim 11 wherein said first base sections include an aperture therein which allows the user of the bed to access the area under the bed for storage.

14. A bed platform apparatus for supporting a mattress comprising:

a plurality of first base sections each having a first and a second surface and top and bottom edges and a first and second side, said top edge having a plurality of slots therein and further including a plurality of fastener engagement means located along said top edge and forming an integral part thereof, said fastener engagement means comprising at least one projection having threads on the exterior thereof;

a plurality of second base sections each having a first and a second surface and top and bottom edges, and a first and second side, said bottom edge having a plurality of slots therein, wherein when said first and second base sections are positioned to cross each other and said slots in the top edge of said first base sections engage the slots in the bottom edge of said second base sections, said first and second base sections form a base;

a plurality of deck sections each having a top surface, a bottom surface and sides, said deck sections including at least one aperture therein;

a plurality of fastener means for passing through said aperture in said deck sections; said fastener means comprising:

a hollow body section having a first end and a second end and an interior sidewall;

a flange section located at said first end of said bottom section;

an attachment section located at said second end of said bottom section for engaging said fastener engagement means located on said top edge of said first base sections;

a fin attached to the interior side wall of said hollow body, wherein said fastener means includes an aperture therein having interior threads therein for mating with the exterior threads of said fastener engagement means; and, wherein when said fastener means is passed through said aperture in at least one of said deck sections and when said fastener means is subsequently rotated, the interior threads of said fastener means engage the exterior threads of said fastener engagement means so that continued rotation of said fastener means brings said flange section into contact with the top surface of said deck sections thereby securing said deck sections to said base, and wherein the hand of an individual can contact said fin to rotate said fastener means to cause said fastener means to securely attach said deck section to said base without the need of a tool.

15. The apparatus of claim 14 further comprising:

a plurality of slots located along the top edge of said section base section; and, a plurality of said deck support means each having at least one slot therein for engaging at least one slot in the top edge of said second base section, wherein when said deck support means are attached to selected second sections they provide additional support for the abutting sides between deck sections.

16. The apparatus of claim 15 wherein said deck support means comprise a plurality of tabs.

17. The apparatus of claim 15 wherein said deck support means comprise a plurality of ribs that span the width of said apparatus.

18. A bed platform apparatus for supporting a mattress comprising:

a plurality of first base sections each having a first and a second surface and top and bottom edges and a first and second side, said top edge having a plurality of slots therein and further including a plurality of threaded fastener engagement means located along said top edge and forming an integral part thereof, a plurality of second base sections each having a first and a second surface and top and bottom edges, and a first and second side, said bottom edge having a plurality of slots therein, wherein when said first and second base sections are positioned to cross each other and said slots in the top edge of said first base sections engage the slots in the bottom edge of said second base sections, said first and second base sections form a base;

a plurality of deck sections each having a top surface, a bottom surface and sides, said deck sections including at least one aperture therein;

a plurality of fastener means for passing through said aperture in said deck sections; said fastener means comprising:

a hollow body section having a first end and a second end and an interior sidewall;

a flange section located at said first end of said bottom section;

a threaded attachment section located at said second end of said bottom section for engaging said threaded fastener engagement means located on said top edge of said first base sections;

a fin attached to the interior side wall of said hollow body; and, wherein when said fastener means is passed through said aperture in at least one of said deck sections and when said fastener means is subsequently rotated, the threads of said threaded fastener attachment section engage the threads of said threaded fastener engagement means so that continued rotation of said fastener means brings said flange section into contact with the top surface of said deck sections thereby securing said deck sections to said base, and wherein the hand of an individual can contact said fin to rotate said fastener means to cause said fastener means to securely attach said deck section to said base without the need of a tool.

* * * * *